US007562974B2

(12) United States Patent
Nishitani et al.

(10) Patent No.: US 7,562,974 B2
(45) Date of Patent: Jul. 21, 2009

(54) IMAGE RECORDING APPARATUS AND SHEET MATERIAL TRANSPORTING APPARATUS

(75) Inventors: Hitoshi Nishitani, Ohta-ku (JP); Gen Kitamura, Ohta-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 11/258,358

(22) Filed: Oct. 25, 2005

(65) Prior Publication Data

US 2006/0092255 A1 May 4, 2006

(30) Foreign Application Priority Data

Oct. 29, 2004 (JP) ..... 2004-315104
Dec. 2, 2004 (JP) ..... 2004-349554

(51) Int. Cl.
*B41J 2/01* (2006.01)

(52) U.S. Cl. ..... 347/104; 347/101; 347/16

(58) Field of Classification Search ..... 347/104, 347/16, 101

See application file for complete search history.

(56) References Cited

U.S. PATENT DOCUMENTS 4,825,245 A * 4/1989 Fukae et al. ..... 399/110
5,742,301 A 4/1998 Ikeda et al.
6,084,624 A * 7/2000 Yamakawa ..... 347/175
6,332,068 B2 * 12/2001 Blackman et al. ..... 399/364
6,470,169 B2 * 10/2002 Nakazato ..... 399/388
6,690,909 B2 * 2/2004 Su ..... 399/364
2002/0001027 A1 1/2002 Sugioka et al.
2004/0028447 A1 2/2004 Sasaki
2004/0179053 A1 * 9/2004 Itoh ..... 347/16
2004/0190970 A1 9/2004 Sasaki et al.
2005/0195263 A1 * 8/2005 Marra et al. ..... 347/104
2005/0253886 A1 * 11/2005 Nakajima et al. ..... 347/16

FOREIGN PATENT DOCUMENTS

JP 04235846 A * 8/1992
JP 05213487 A * 8/1993
JP 07-300251 11/1995
JP 9-40230 2/1997
JP 2002-234636 8/2002

OTHER PUBLICATIONS

JP404235846A—Patent Abstracts of Japan, English Translation, Aug. 24, 1992.*
JP405213487A—Patent Abstracts of Japan, English Translation, Aug. 24, 1993.*

* cited by examiner

*Primary Examiner*—Matthew Luu
*Assistant Examiner*—Henok Legesse
(74) *Attorney, Agent, or Firm*—Canon USA Inc IP Div

(57) ABSTRACT

A U-shaped transport path has a pair of transport rollers and a pair of rotating rollers which convey the sheet material at the maximum curvature along the U-shaped transport path so that an image recording apparatus can be miniaturized.

10 Claims, 17 Drawing Sheets

FIG.5A1
PRIOR ART
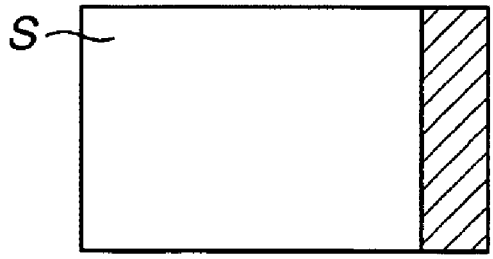
FIG.5A2
PRIOR ART
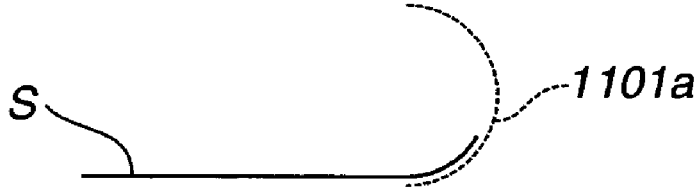
FIG.5B1
PRIOR ART
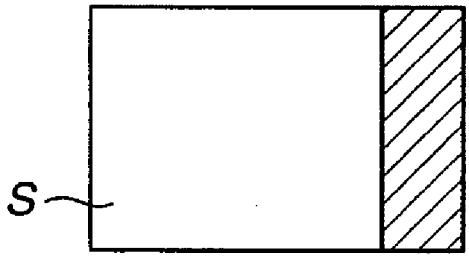
FIG.5B2
PRIOR ART
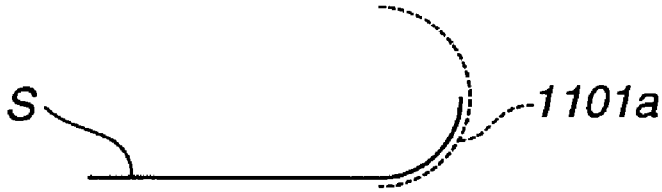
FIG.5C1
PRIOR ART
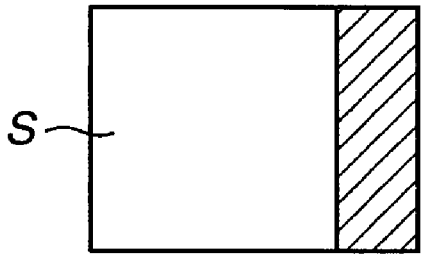
FIG.5C2
PRIOR ART
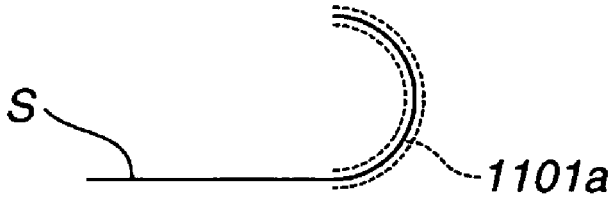

FIG.7A1
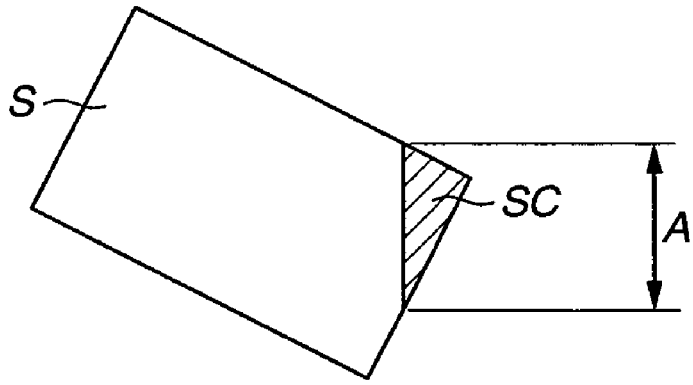
FIG.7A2
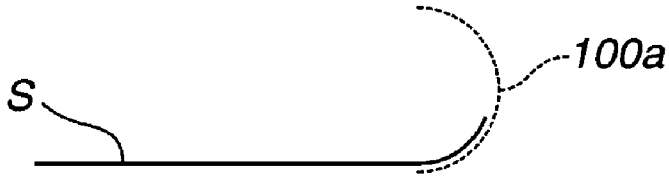
FIG.7B1
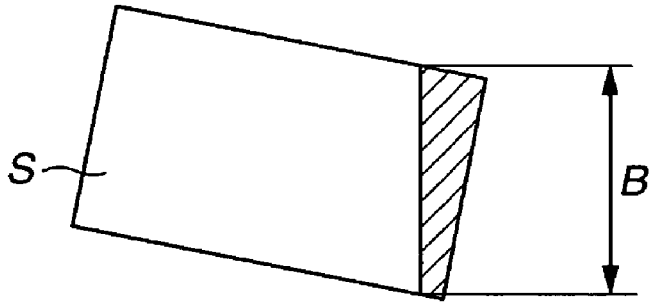
FIG.7B2
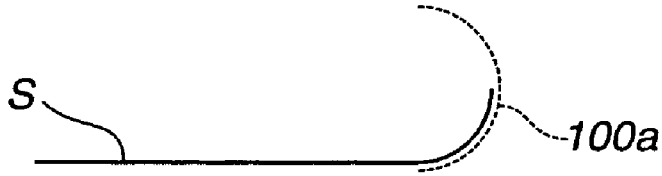
FIG.7C1
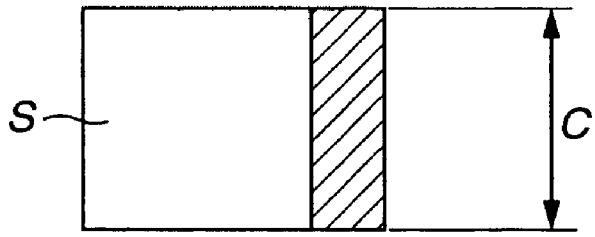
FIG.7C2
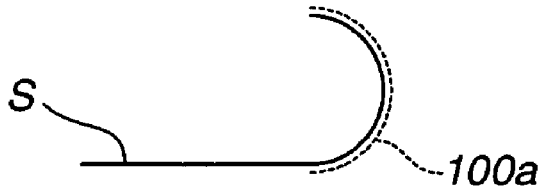

IMAGE RECORDING APPARATUS AND SHEET MATERIAL TRANSPORTING APPARATUS

BACKGROUND OF THE INVENTION

1. Field of the Invention

The present invention relates to an image recording apparatus for recording an image on a substantially rectangular sheet-like recording medium, and a sheet material transporting apparatus.

2. Description of the Related Art

FIG. 21 is a sectional view of a conventional sheet material transporting apparatus.

In FIG. 21, a sheet material transporting apparatus conveys the sheet material S in the direction of the arrow A (leftward in FIG. 21) by a pair of transport rollers 1102 to guide it into a U-shaped transport path 1101 having a curved portion 1101*a*. In this configuration the sheet material S is conveyed above a pair of transport rollers 1102 along the U-shaped transport path 1101.

The transport rollers 1102 are rotatably driven by a drive unit (not shown), so as to subject the surface of the sheet material S to a friction force and advance the sheet material S in the direction of the arrow A.

FIG. 22 is a sectional view of a conventional image recording apparatus including a recording medium transporting apparatus which is similar to the sheet material transporting apparatus of FIG. 21.

In a recording medium transporting apparatus of FIG. 22, a sheet feeding roller 1206 feeds sheet material S stacked on a sheet material stacking unit 1201 into a U-shaped transport path 1202. The sheet material S is guided by the U-shaped transport path 1202 in a U-shape, and then fed to a print unit 1203 disposed above the sheet material stacking unit 1201.

The print unit 1203 is provided with discharging rollers 1207 for holding the sheet material S and feeding it downstream. Downstream of the print unit 1203, a U-shaped transport path 1204 is disposed.

The sheet material S is fed into the U-shaped transport path 1204 by the discharging rollers 1207 after the image-recording, and discharged to a discharging tray 1205 disposed above the print section 1203 while being guided in a curve by the U-shaped transport path 1204.

In this way, the U-shaped transport path is generally used in order to change the transport direction of the sheet material in a sheet material transporting apparatus which conveys the sheet material S to perform a predetermined processing.

Relevant techniques are disclosed in Japanese Patent Application Laid-Open No. 2002-234636 and Japanese Patent Application Laid-Open No. 9-40230.

As shown in FIGS. 23A to 23C, each curved portion of the U-shaped recording medium transport paths 1202, 1204 can have various curvatures. The curvature has a maximum value in FIG. 23A, a minimum value in FIG. 23C, and an intermediate value in FIG. 23B.

The whole apparatus becomes large in size when the curvature is small as shown in FIG. 23C, and the whole apparatus becomes small in size when the curvature is large as shown in FIG. 23A.

On the other hand, if the curvature is as large as shown in FIG. 23A, when the sheet material S is fed into the U-shaped transport paths 1202, 1204, the sheet material S may be strongly inflected so as to buckle, and the sheet material S cannot be conveyed.

Therefore, the curvature of the U-shaped transport path should be preferably as large as possible so long as the sheet material S can be conveyed and pass through the path. In general, the maximum curvature, at which the sheet material S can be smoothly curved along the U-shaped transport path 1202, 1204 when being fed into the U-shaped transport path 1202, 1204, is referred to as "the maximum curvature".

The factors that determine "the maximum curvature" include the transport speed, the material of the transport path (friction coefficient), the driving force and the location of the transport roller, however, the thickness and the width of the U-shaped sheet material S are the factors that have the most direct impact in determining "the maximum curvature".

That is, if it is thick or wide, the sheet material S has high rigidity, therefore it becomes difficult to curve the sheet material S. Accordingly, maximum curvature is reduced and, as a result, the size of the whole image recording apparatus becomes larger.

In the above-mentioned conventional sheet material transporting apparatus, the thickness or width of the chosen sheet material defines "the maximum curvature", which imposes a limit on miniaturization of the apparatus. On the other hand, "the maximum curvature" defines the upper limits of the thickness and width of the conveyable sheet material, if "the maximum curvature" is constant.

The printing apparatus for forming an image on recording paper according to image information can be classified into a heat transfer type, a thermosensitive type, an ink jet type, a wire dot type, and a laser beam type, etc. depending on the image forming method employed by the recording head. FIG. 24 is a diagrammatic vertical sectional view which shows the schematic arrangement of a heat transfer type printing apparatus. In FIG. 24, reference numeral 2101 designates a thermal head as a recording head; reference numeral 2102, a platen roller for guiding and supporting recording paper P through the thermal head 2101; reference numeral 2103, an ink sheet to which a transfer ink is applied; and reference numeral 2104, a pair of sheet feeding rollers disposed downstream in the transport direction of the thermal head 2101 for transporting the recording paper P.

The recording paper P is brought into pressure contact with the thermal head 2101 by the platen roller 2102, and ink of the ink sheet 2103 is transferred to the recording paper P by the heat it produces, while a pair of sheet feeding rollers 2104 is transporting the recording paper P. During this process, the recording paper P is pulled and conveyed in the arrow direction by the sheet feeding rollers 2104, while the recording paper p is pressed into contact with the platen roller 2102 by the thermal head 2101. This allows the recording paper P to be constantly subjected to tension between the thermal head 2101 and the sheet feeding rollers 2104, which leads to accurate conveyance. Printing is performed by the thermal head 2101 on the recording paper P which is thus accurately conveyed. A thermo-transfer type printer using a thermal head is disclosed for example, in Japanese Laid-Open Patent Publication No. 9-93501.

FIG. 25 is a diagrammatic vertical sectional view which shows the schematic arrangement of an ink jet type printing apparatus. In FIG. 25, reference numeral 2201 designates an ink tank for storing ink used for image-forming; reference numeral 2202, an ink jet head as an image forming unit comprising a plurality of discharge ports for selectively jetting ink, supplied from the ink tank 2201, based on image information; reference numeral 2203, a carriage carrying the ink tank 2201 and the ink jet head 2202, and reciprocally moving in the main scanning direction; reference numeral 2204, a guide shaft for guiding and supporting the reciprocally moving carriage 2203; reference numeral 2205, sheet feeding rollers disposed upstream of the ink jet head 2202 in the transport direction, for transporting the recording paper P; and reference numeral 2206, a platen for supporting the recording paper P which is being fed through the ink jet head 2202.

The carriage 2203 is reciprocally driven in the width direction of the recording paper (in a direction vertical to the drawing) by a moving unit (not shown). The recording head 2202 is driven based on the image information in synchronization with the movement of the carriage 2203 so that the ink is jetted from the discharge port train of the recording heads 2202 in accordance with the image in order to print the image on the recording paper P. When the printing corresponding to the length of said plurality of discharge ports (a recording width of one line) is finished, the sheet feeding rollers 2205 conveys the recording paper P by a predetermined pitch, and the recording paper P is stopped at the next line. Then, the carriage 2203 is moved again and the recording head 2202 is driven to print the next line. Thus, the recording of one line and the sheet-feeding by a predetermined pitch are repeated in turn to perform printing on the recording paper P.

In these days, there have been increased requests for printing out image information from digital cameras and digital video cameras, etc., simply in a photographical manner, and printing on the whole recording paper without a margin as in a margin-less photograph. However, in the case where the sheet feeding rollers 2104 are arranged downstream in the transport direction of the recording head 2101 (thermal head) as in the printing apparatus shown in FIG. 24, an unprintable area appears from the leading edge (front edge) of the recording paper P in a range shown by the two arrows X. On the other hand, in the case where the sheet feeding rollers 2105 are arranged upstream of the recording head 2202 in the transport direction, an unprintable area appears from the trailing edge of the recording paper P in a range shown by two arrows Y.

The recording paper P cannot be conveyed unless the recording paper P is nipped by the sheet feeding rollers 2104 and 2205, while the recording paper P cannot be printed unless the recording paper P is being conveyed, as a result the unprintable range appears. Therefore, in the case of FIG. 24, printing is not performed in a range shown by the two arrows X from the leading edge of the recording paper P, whereas in the case of FIG. 25, printing is not performed from the trailing edge of the recording paper P in a range shown by the two arrows Y. As a method of solving the above-mentioned problems, sheet feeding rollers are disposed in both front and back of the image forming unit (recording head portion).

FIG. 26 is a diagrammatic vertical sectional view which shows the schematic arrangement of a printing apparatus in which the thermo-transfer type printing apparatus of FIG. 24 additionally has sheet feeding rollers 2105 upstream of the recording head 2101 in the transport direction, and FIG. 27 is a diagrammatic vertical sectional view which shows the schematic arrangement of a printing apparatus in which an ink jet type printing apparatus additionally has sheet feeding rollers 2207 downstream in the transport direction of the recording head 2202. According to the configuration shown in FIGS. 26 and 27, the recording paper is conveyed through the image forming unit with the recording paper P being nipped constantly by at least one pair of sheet feeding rollers, so that the image can be printed on the whole surface of the recording paper P without making a margin.

However, in a case where the conveyance is carried out by two sets of sheet feeding rollers as shown in FIGS. 26 and 27, the image forming unit is inevitably located between two different sets of sheet feeding rollers. In this configuration in which conveyance is performed by two sets of sheet feeding rollers, the diameter of the roller and the transport speed have to be adjusted in minute detail so as to prevent the image forming unit from losing or excessively increasing the tension of the recording paper. This requires highly accurate machining of components and automatic control, which leads to technical problems such us upsizing of the apparatus or complication of the controlling system.

SUMMARY OF THE INVENTION

The invention has been made in order to solve the above-mentioned conventional problems. The invention is directed to setting "the maximum curvature" of a transport path larger than before, when the recording paper has a given thickness and width, so as to miniaturize the apparatus. In other words, the invention is directed to making it possible to convey recording paper which is larger in thickness and width than before, when the transport path has a determined "maximum curvature".

Further, the invention is directed to providing a printing apparatus and a printing method which are capable of printing an image on the whole surface of the recording paper without making a margin even when sheet feeding rollers are not disposed both front and back of an image forming unit, but at either the front or the back of the image forming unit.

According to one aspect of the invention, a sheet material transporting apparatus includes a recording unit that records an image on a substantially rectangular sheet-like recording medium; a transport path that conveys the sheet-like recording medium toward the recording unit in a direction perpendicular to a normal line of the surface of the sheet-like recording medium, and that has a curved portion formed thereon, the curved portion having such a shape that curvature of the sheet-like recording medium being conveyed through the transport path becomes, in part, large; and a rotating unit that rotates the sheet-like recording medium in the transport path around an axis along the normal line of the surface of the sheet-like recording medium, wherein the rotating unit increases the part of the sheet-like recording medium reaching the curved portion during a process from (1) starting a rotating operation of the sheet-like recording medium in the transport path to (2) terminating the rotating operation.

According to the above configuration, it is possible to set "the maximum curvature" larger than before, when the sheet-like recording medium has a determined thickness and width so as to miniaturize the apparatus. In other words, it is possible to set the allowable thickness and width of the sheet-like recording medium larger than before, when the sheet-like recording medium has a determined "maximum curvature".

In another aspect of the invention, the rotating unit includes a nipping unit that nips the sheet-like recording medium on both of the surfaces thereof, and a rotating drive unit that rotates the nipping unit around a rotational center axis along the normal line of the surface of the sheet-like recording medium. In another aspect of the invention, the rotating unit includes a transport unit that advances the sheet-like recording medium in a direction perpendicular to the normal line of the surface of the sheet-like recording medium, and an abutting unit that prevents the sheet-like recording medium from advancing. In another aspect of the invention, the rotating unit includes a first transport unit that advances the sheet-like recording medium in a direction perpendicular to the normal line of the surface of the sheet-like recording medium, and a second transport unit that advances the sheet-like recording medium in a direction perpendicular to the normal line of the surface of the sheet-like recording medium and in a direction different from the advancing direction driven by the first transport unit.

According to another aspect, an image recording apparatus includes a transport path that conveys a substantially rectangular sheet material in a direction perpendicular to a normal line of the surface of the sheet material, and that has a curved portion formed thereon, the curved portion having such a shape that curvature of the sheet material being conveyed through the transport path becomes, in part, large; and a rotating unit that rotates the sheet material in the transport path around an axis parallel with the normal line of the surface of the sheet material, wherein the rotating unit increases the part of the sheet-like recording medium reaching the curved portion during a process from (1) starting a rotating operation of the sheet material in the transport path to (2) terminating the rotating operation.

According to the above configuration, it is possible to set "the maximum curvature" larger than before, when the sheet-like recording medium has a determined thickness and width so as to miniaturize the apparatus. In other words, it is possible to set the allowable thickness and width of the sheet-like recording medium larger than before, when the sheet-like recording medium has a determined "maximum curvature".

Moreover, according to further aspect, a printing apparatus for printing the image, includes an image forming unit that forms an image on recording paper; a transport unit that conveys the recording paper through the image forming unit; and a rotating unit that reverses the recording paper in the transport path with respect to the forward-and-rearward direction, wherein the printing apparatus sequentially performs a first printing process of printing the image in a region excluding a range of one end of the recording paper where a transport force is not applied by the transport unit when the recording paper passes through the image forming unit ; a reversing process of reversing the recording paper with respect to the forward-and-rearward direction; and a second printing process of printing the image in a region excluding a range of another end of the recording paper where a transport force is not applied by the transport unit when the recording paper passes through the image forming unit.

Therefore, it is possible to convey the sheet-like recording medium having a given thickness and width through the transport path which has larger "maximum curvature" than before so that the apparatus can be miniaturized. In other words, it is possible to convey recording paper which is larger in thickness and width than before, even when the transport path has a given "maximum curvature".

Also, in the further aspect, there is provided a printing apparatus and a printing method which are capable of printing the image on the whole surface of a recording paper without making a margin even when sheet feeding rollers are not disposed both front and back of an image forming section, but only at either the front or the back of the image forming section.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 5A1 to 5C2 are views which show how the sheet material is curved in the conventional sheet material transporting apparatus.

FIGS. 7A1 to 7C2 are views which show how the sheet material is curved in the sheet material transporting apparatus of FIG. 1.

FIG. 13A shows the transport state before rotation, FIG. 13B shows the state during rotation, and FIG. 13C shows the transport state after rotation.

DETAILED DESCRIPTION OF THE EMBODIMENTS

Embodiments of the invention are described in detail below with reference to the drawings.

Sheet Material Transporting Apparatus

Figure 1:
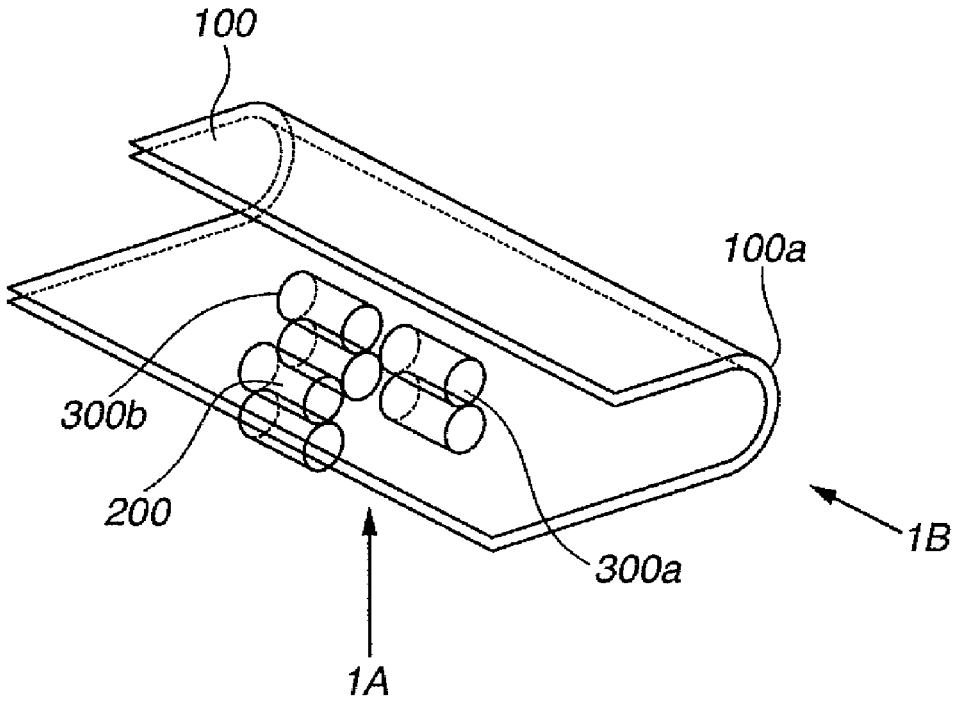
FIG. 1 is a perspective view of a sheet material transporting apparatus according to an embodiment of the invention.
Figure 2:
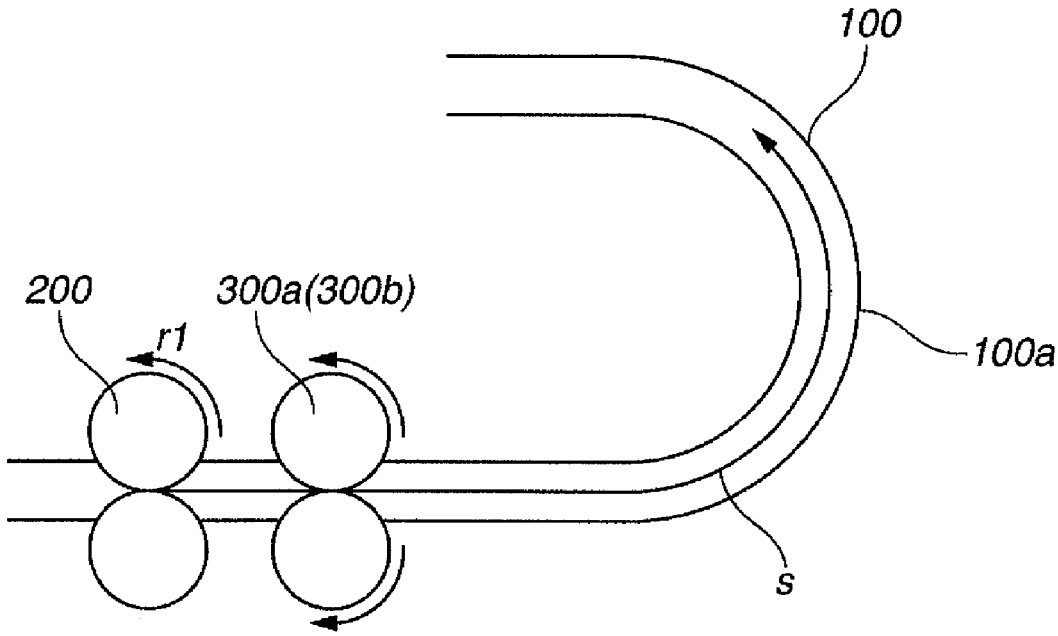
FIG. 2 is a side view of the sheet material transporting apparatus of FIG. 1, viewed in the direction of the arrow 1B.

FIG. 1 is a perspective view of a sheet material transporting apparatus according to an embodiment of the invention; FIG. 2 is a side view of the sheet material transporting apparatus in FIG. 1, viewed in the direction of the arrow 1B; and FIG. 3 is a bottom view of the sheet material transporting apparatus of FIG. 1, viewed in the direction of the arrow 1A.

Figure 3:
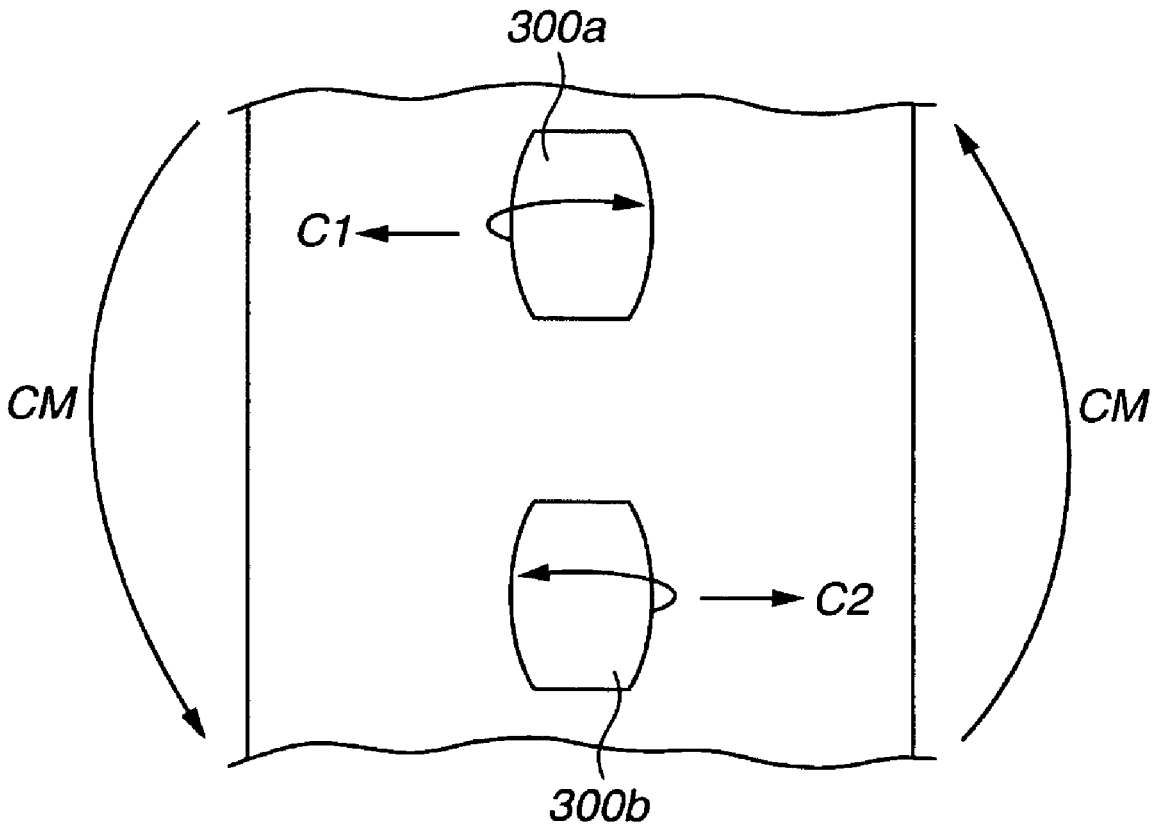
FIG. 3 is a bottom view of the sheet material transporting apparatus of FIG. 1, viewed in the direction of the arrow 1A.

In FIGS. 1 to 3, the sheet material transporting apparatus has a sheet material transport path 100 including a substantially flat portion, and a curved portion 100*a* following the flat portion, and a pair of transport rollers 200 feeding the sheet material S into the sheet material transport path 100. The sheet material transport path 100 can guide the recording paper S in a direction perpendicular to a normal line of the surface of the recording paper S.

The transport rollers 200 are rotated by a drive unit (not shown), and apply a friction force to the surface of the sheet material S to advance the sheet material S in its rotating direction (r1 direction in FIG. 2)

The sheet material transport apparatus has a pair of rotating rollers 300*a*, and a pair of rotating rollers 300*b* downstream of the transport rollers 200. The respective rotating rollers 300*a*, 300*b* rotate the sheet material S nipping it on both its surfaces.

The pair of rotating rollers 300*a* and the pair of rotating rollers 300*b* are substantially coaxial with each other, and arranged in a line in the width direction of the sheet material S.

The rotating rollers 300*a*, 300*b* are rotated by a drive unit (not shown), whose rotation direction can be arbitrarily set.

As shown in FIG. 3, when the rotating rollers 300*a*, 300*b* are rotated in opposite directions to each other (e.g. in the C1 direction for the pair of rotating rollers 300*a*, and in the C2 direction for the pair of rotating rollers 300*b*), the sheet material S is subjected to force couple in the CM direction (counter-clockwise). That is, pairs of rotating rollers 300*a*, 300*b* function as a rotating unit for the sheet material S, in other words, apply mutually opposed transport forces to the sheet material S to subject the sheet material S to a force couple.

The force couple is created in such a manner that the advancing directions defined by the pair of rotating rollers 300*a* and by the pair of rotating rollers 300*b* are perpendicular to a normal line of the surface of the sheet material S, respectively, and are different from each other.

The rotating unit is not restricted to the configuration in FIGS. 1 to 3, and various configurations such as disclosed in Japanese Patent Application Laid-Open No. 2002-234636, and Japanese Patent Application Laid-Open No. 9-40230, etc. can be employed. According to Japanese Patent Application Laid-Open No. 2002-234636, the advancing direction of a sheet S is changed by nipping the sheet S on its both surfaces with a nipping unit, and then rotating the nipping unit by 90°. According to Japanese Patent Application Laid-Open No. 9-40230, an image-forming sheet P is advanced causing one side of the leading edge in the width direction of the image-forming sheet P to abut a stopper (an abutting unit) and by a guiding roller as a guiding unit disposed on the other side of the leading edge in the width direction of the image-forming sheet P. As a result the image-forming sheet P is rotated around the stopper, then further rotated by a tilted roller.

Further, the recording material S can be conveyed by a pair of the rotating rollers 300*a*, 300*b* in place of a pair of the transport rollers 200, and a pair of the transport rollers can be omitted.

Figure 4A:
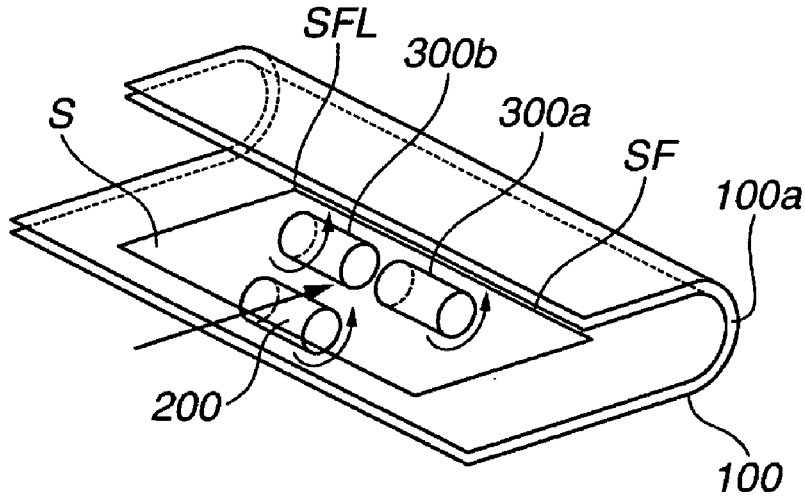
FIGS. 4A to 4C are perspective views which sequentially show the movement of the sheet material in the sheet material transporting apparatus of FIG. 1.
Figure 4B:
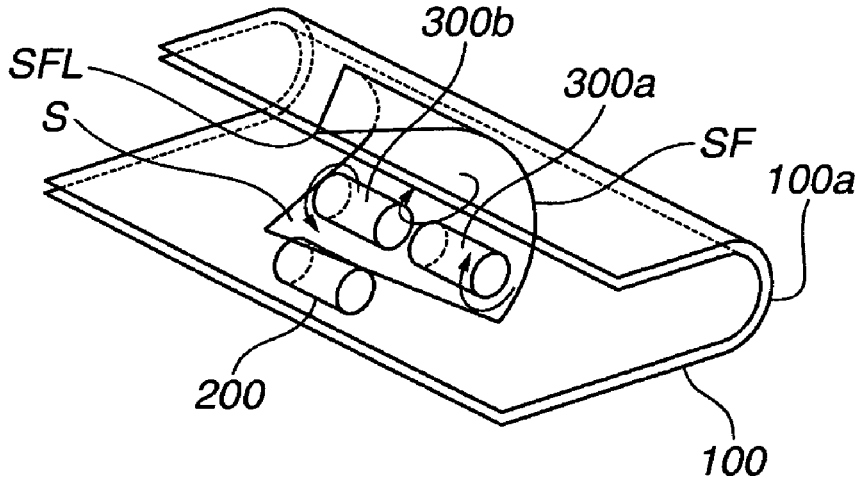
Figure 4C:
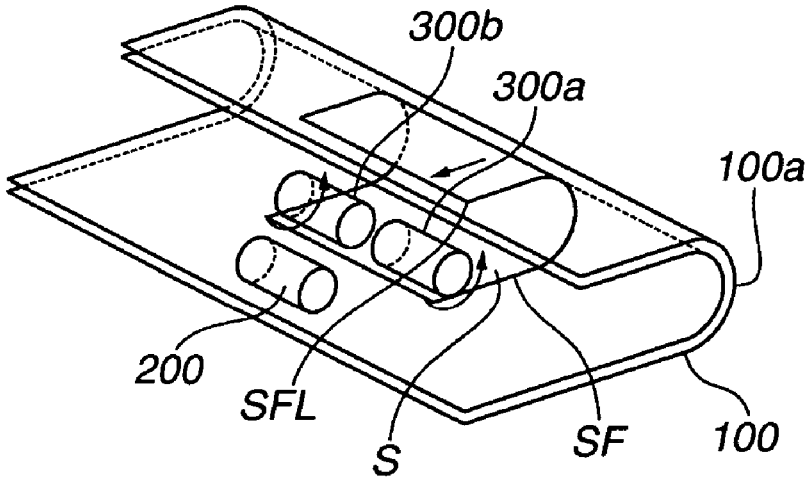

FIGS. 4A to 4C are perspective views which sequentially show the movement of the sheet material S in the sheet material transporting apparatus in FIG. 1. FIGS. 4A to 4C show only one roller 200, 300*a*, and 300*b* out of the pair of transport rollers 200, and rotating rollers 300*a*, 300*b* for better understanding.

In FIG. 4A, all the rollers 200, 300*a*, 300*b* are rotatably driven in such a direction as to advance the sheet material S along the sheet transport path 100, and the sheet material S is conveyed until the leading edge SF of the sheet material S advances a predetermined distance over the rollers 300*a*, 300*b*. At this stage, the sheet material S does not reach the curved portion 100*a*.

Next, as shown in FIG. 4B, the rollers 300*b* are rotated in the advancing direction as in FIG. 4A, and the rollers 300*a* are counter-rotated in the reverse direction, so that the sheet material S is subjected to a force couple in a clockwise direction (CM direction) with respect to the advancing direction, as described with reference to FIG. 3. The sheet material S is rotated by 90° in the CM direction by the rollers 300*a*, 300*b*, and the left end SFL of the leading edge SF, shown in FIG. 4A, is moved forward. The size of the sheet material transport path 100 and the positions of the rollers 200, 300*a*, and 300*b* are set such that part of the sheet material S is rotatively introduced into the curved portion 100*a*.

Next, as shown in FIG. 4C, the rollers 200, 300*a*, 300*b* are rotatably driven in the advancing direction, and the sheet material S advances along the sheet transport path 100 while passing through the curved portion 100*a*.

Consequently, the transport load can be reduced in the sheet material transport path 100, especially at the curved portion 100*a*, and the maximum curvature of the curved portion 100*a* can be set larger than before, taking into account thickness and width of the sheet material s.

In order to clarify advantageous effects according to the present embodiment, the transport load of the conventional sheet material transporting apparatus is now discussed. FIGS. 5A1 to 5C2 are views showing that the sheet material is curved in a conventional sheet material transporting apparatus, and FIG. 6 is a graph which shows the transport load of the conventional sheet material transporting apparatus.

FIGS. 5A1 and 5A2 are a plan view and a side view, respectively, which show that the sheet material S starts to be introduced into a curved portion 1101*a*. FIGS. 5B1 and 5B2 are a plan view and a side view, respectively, which show that the sheet material S enters into the curved portion 1101*a*. FIGS. 5C1 and 5C2 are a plan view and a side view, respectively, which show that the sheet material S reaches an end of the curved portion 1101*a*. In FIGS. 5A1, 5B1, and 5C1, the hatching shows the extent to which the sheet material S enters into the curved portion 1101*a*.

It is known that, in the conventional sheet material transporting apparatus, the transport load increases between the state of FIGS. 5A1, 5A2 and the state of FIGS. 5B1, 5B2 in which the sheet material S makes the transition from the flat form to the curved form, and decreases in the state of FIGS. 5B1, 5B2 after the sheet material S has been completely curved along the curved portion 1101*a*.

Figure 6:
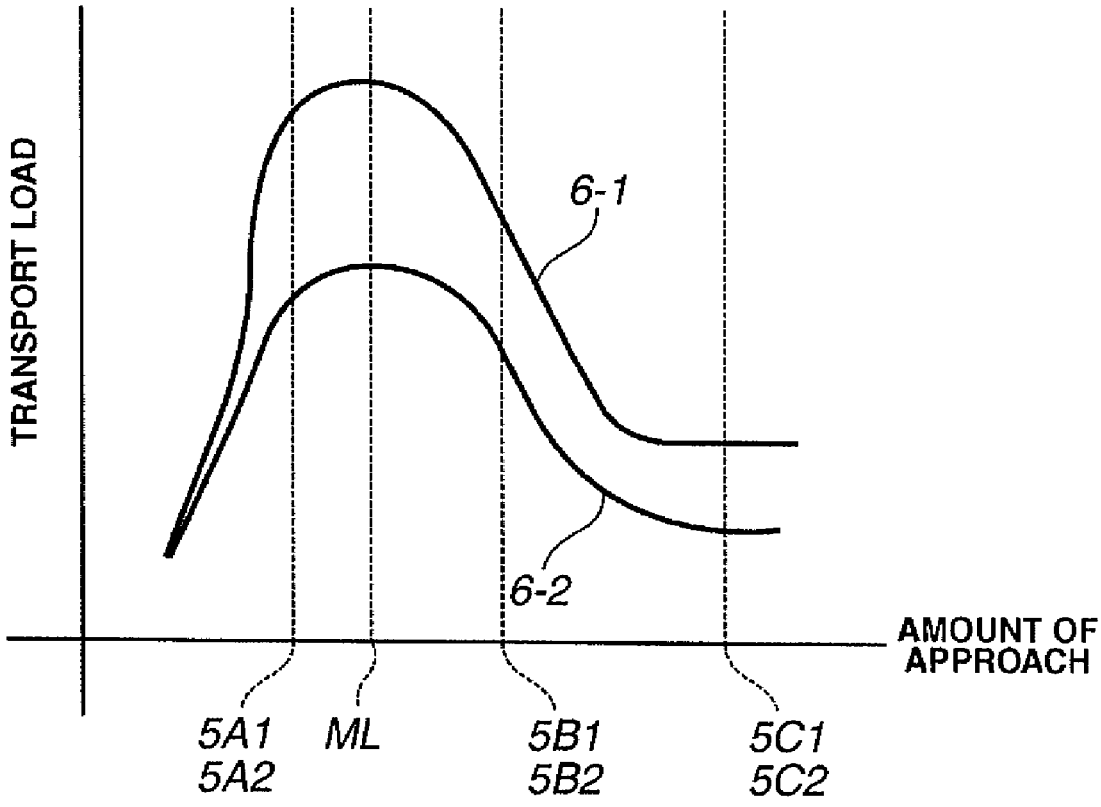
FIG.6 PRIOR ART
FIG. 6 is a graph which shows the transport load in the sheet material transporting apparatus of FIG. 1.

In the graph of FIG. 6, the axis of the abscissa represents an approach amount of the sheet material S entering into the curved portion 1101*a*, and the axis of the ordinate represents the transport load. The transport load reaches a maximum (referred to as "the maximum transport load") in a process of the transition from the state of FIGS. 5A1, 5A2 to the state of FIG. 5C1, 5C2, and thereafter the transport load gradually decreases. In FIG. 6, the amount of approach at which the maximum transport load is realized is designated as ML.

As the curvature of the curved portion 1101*a* increases, the maximum transport load increases. When the maximum transport load exceeds the transport capacity of the transport rollers 1102, or the sheet material S is buckled, the sheet material S cannot be conveyed. Then, the curvature is "the maximum curvature" which is a conveying limitation.

Further, the transport load is proportional to the stress required to curve the sheet material S. The transport load becomes greater when the sheet material S is large in width (the curve 6-1 in FIG. 6), than when it is small in width (the curve 6-2 in FIG. 6).

The transport load in this embodiment will now be described below.

Figure 8:
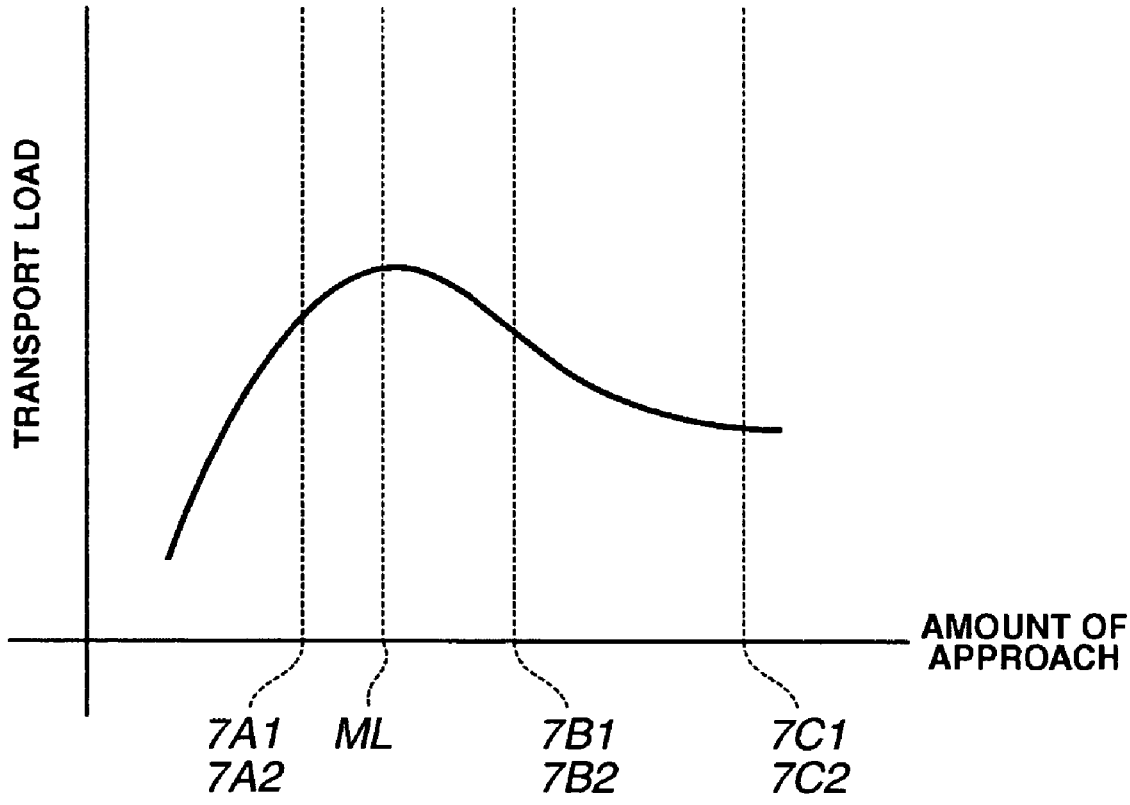
FIG. 8 is a graph which shows the transport load of the sheet material transporting apparatus of FIG. 1.

FIGS. 7A1 to 7C2 are views which show that the sheet material is curved in the sheet material transporting apparatus of FIG. 1, and FIG. 8 is a graph which shows the transport load of the sheet material transporting apparatus of FIG. 1.

FIGS. 7A1 and 7A2 are a plan view and a side view, respectively, which show that the sheet material S starts to be introduced into the curved portion 100*a*. FIGS. 7B1 and 7B2 are a plan view and a side view, respectively, which show that the sheet material S further enters into the curved portion 100*a*. FIGS. 7C1 and 7C2 are a plan view and a side view, respectively, which show that the sheet material S reaches an end of the curved portion 100*a*. In FIGS. 7A1, 7B1, and 7C1, the hatching shows the extent to which the sheet material S enters the curved portion 100*a*.

In each of FIG. 7A1 to 7C2, since the sheet material S gradually enters the curved portion 110*a* while being rotated, the maximum width of the hatched portion gradually increases as shown in FIG. 7A1 as the width A, in FIG. 7B1 as the width B, and in FIG. 7C1 as the width C. In other words, only a corner portion SC of the sheet material S approaches the curved portion 100*a* in FIGS. 7A1 and 7A2. In FIGS. 7B1 and 7B2, the whole width of the sheet material S obliquely approaches the curved portion 100*a*, and the sheet material S straightforwardly approaches the curved portion 100*a* in FIGS. 7C1 and 7C2. Thus, the rotating unit increases the part of the sheet-like recording medium reaching the curved portion during a process from (1) starting the rotating operation of the sheet-like recording medium in the transport path to (2) terminating the rotating operation.

The widths A, B, and C satisfy A<B, and A<C, and the width B is substantially equal to the width C; therefore, the widths A, B, and C of the curved portions are deemed to gradually increase in this order. As a result, the transport load is small at the ML position at which the maximum transport load is conventionally realized, so that, according to the present embodiment, the maximum transport load is reduced compared with the conventional sheet feeding apparatus.

In the case of the conventional sheet material transporting apparatus, since the sheet material S approaches the curved portion 100*a* with the leading edge SF perpendicular to the transport direction, the sheet material S has to be curved simultaneously over the total width. In contrast, in the case of the present embodiment, since the sheet material S approaches the curved portion 100*a* while the width-to-be-curved is being gradually increased. Accordingly, the resistance is decreased as in the case where a narrow width sheet approaches the curved portion.

FIG. 8 shows that the maximum transport load according to the present embodiment is less than the conventional apparatus.

Further, in the case of the sheet material transporting apparatus according to the present embodiment, because the width-to-be-curved gradually increases, the transport load hardly tends to decrease in the posterior half of the sheet, as is the case in the conventional apparatus. However, since the maximum load can be decreased as a whole, the maximum curvature can be set to a larger value.

As described above, according to the sheet material transporting apparatus according to the present embodiment, the sheet material rotatedly approaches the curved portion of the sheet material transport path, so that the width-to-be-curved gradually increases. Therefore, the maximum transport resistance of the sheet material can be decreased, and the sheet material can be conveyed even at a curvature larger than the maximum curvature in the conventional apparatus if the allowable thickness of the sheet material is the same. As a result, the apparatus can be made smaller. Moreover, it is possible to provide a sheet material transporting apparatus in which the upper limit of the thickness of the conveyable sheet material can be further increased if the maximum curvature is the same. As a result, it is possible to realize a miniature sheet material transporting apparatus in which the allowable range of the sheet material can be made wide.

When the thickness of the sheet material S is designated as h, the width as b and the longitudinal elastic coefficient as E, respectively, the curvature radius of the curved portion is designated as ρ, and the transport load is designated as F, the transport load F is substantially proportional to E, b, and $h^3$, and substantially inversely proportional to ρ, as shown in the equation (1) mentioned below. The equation (1) shows that increase of the transport load can be controlled when the sheet material S approaches the curved portion 100*a* and the width b is gradually being increased.

$$F \propto E \times (b \times h^3)/\rho \quad (1)$$

Image Recording Apparatus

Next, an image recording apparatus including the above-mentioned sheet material transporting apparatus according to the present embodiment described with reference to the drawings.

Figure 9:
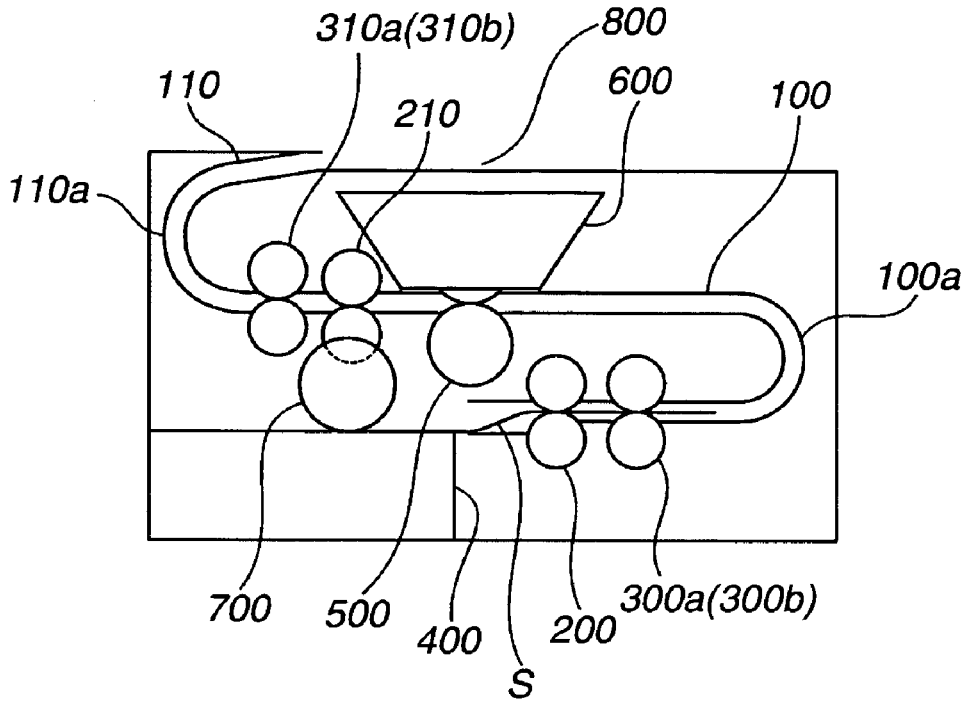
FIG. 9 is a sectional view of an image recording apparatus including a sheet material transporting apparatus according to an embodiment of the invention.

FIG. 9 is a sectional view of an image recording apparatus including the sheet material transporting apparatus according to the present embodiment.

In the sheet material transporting apparatus in FIG. 9, a sheet feeding roller 700 feeds sheet material S stacked on a sheet material stacking unit 400 into a U-shaped transport path 100 including a curved portion 100*a*. The sheet material S is guided in a U-shape by the U-shaped transport path 100, and then fed to a print unit 600 which is a recording unit disposed above the sheet material stacking unit 400.

The print section 600 is provided with discharging rollers 500 for holding the sheet material S and feeding it to the downstream side. A U-shaped transport path 110 is disposed downstream of the print unit 600.

The sheet material S is fed into the curved portion 110*a* by the discharging rollers 500 after the image-recording, and discharged to a discharging tray 800 disposed above the print section 600 while being guided in a U-shape by the U-shaped transport path 110.

Thus, the U-shaped transport path 110*a* is generally used in order to change the transport direction of the sheet material S within a sheet material transporting apparatus which conveys the sheet material S and simultaneously subjects it to predetermined processing.

The U-shaped transport path 100 has a pair of transport rollers 200, and pairs of rotating rollers 300*a*, 300*b*, and the U-shaped transport path 110 has a pair of transport rollers 210, and pairs of rotating rollers 310*a*, 310*b*. The sheet material S is conveyed being curved at the maximum curvature along the U-shaped transport paths 100, 110.

In this configuration, the image recording apparatus can be made small.

Next, the invention will is described in detail with reference to the drawings showing a printing apparatus according to the present embodiment.

Figure 10:
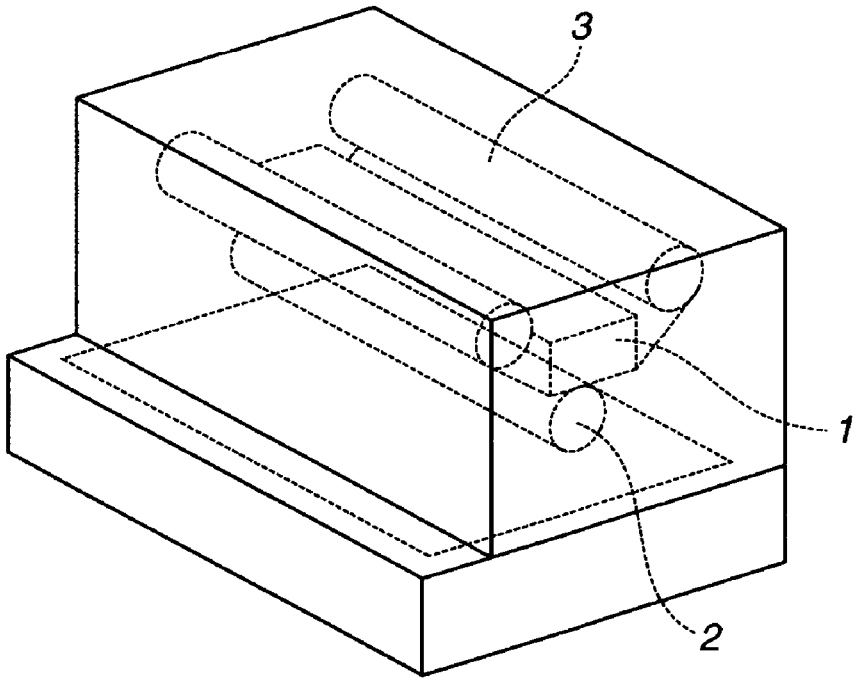
FIG. 10 is a diagrammatic perspective external view of a printing apparatus according to a first embodiment of the present invention.
Figure 11:
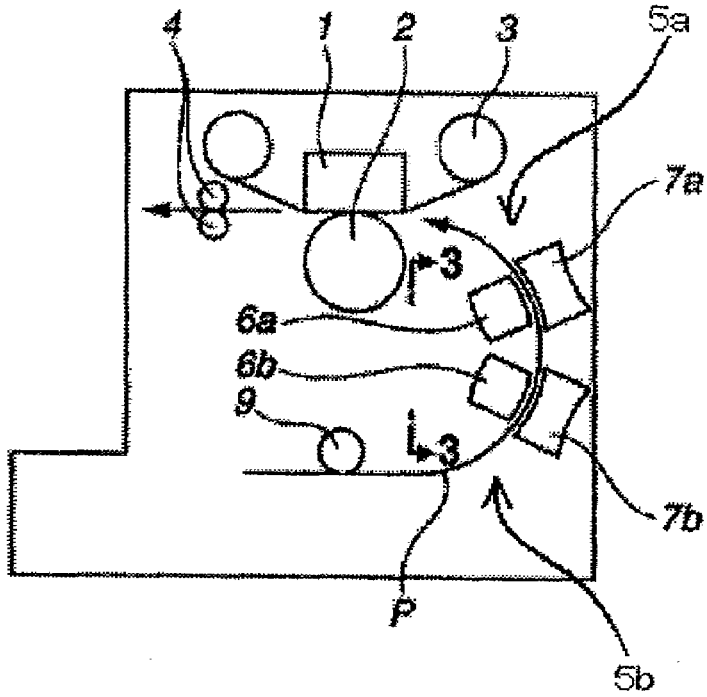
FIG. 11 is a diagrammatic vertical sectional view which shows the schematic arrangement of the printing apparatus according to the first embodiment of the invention.
Figure 12:
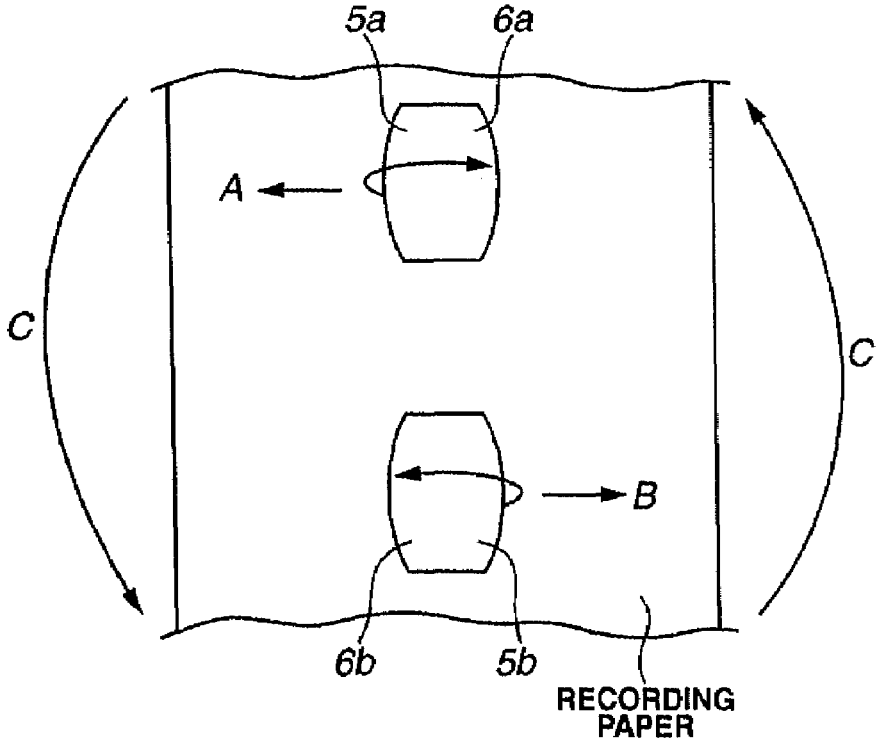
FIG. 12 is a diagrammatic view which shows the configuration and the operation of a rotating unit, viewed in the direction of arrows 3-3 in FIG. 11.

FIG. 10 is a diagrammatic perspective external view of the first embodiment of a printing apparatus, FIG. 11 is a diagrammatic vertical sectional view which shows the schematic arrangement of the first embodiment of the printing apparatus, and FIG. 12 is a diagrammatic view which shows a configuration and operation of a rotating unit, viewed in the direction of arrows 3 from a section connecting end points of arrows 3.

In the present embodiment, a thermal transfer type printing apparatus using a thermal head as a recording head is described as an example.

In FIGS. 10 and 11, reference numeral 1 designates a thermal head as an image forming unit; reference numeral 2, a platen roller; reference numeral 3, an ink sheet; and reference numeral 4, sheet feeding rollers.

The thermal head 1 constituting an image forming unit in the present embodiment has a heat unit including a plurality of heat resistors which are arranged in line at predetermined pitches in the width direction (perpendicular to the sheet surface in FIG. 11) of the recording paper P serving as a recording medium. Reference numeral 9 designates a pickup roller for feeding the recording paper P from a sheet storing unit.

Figure 24:
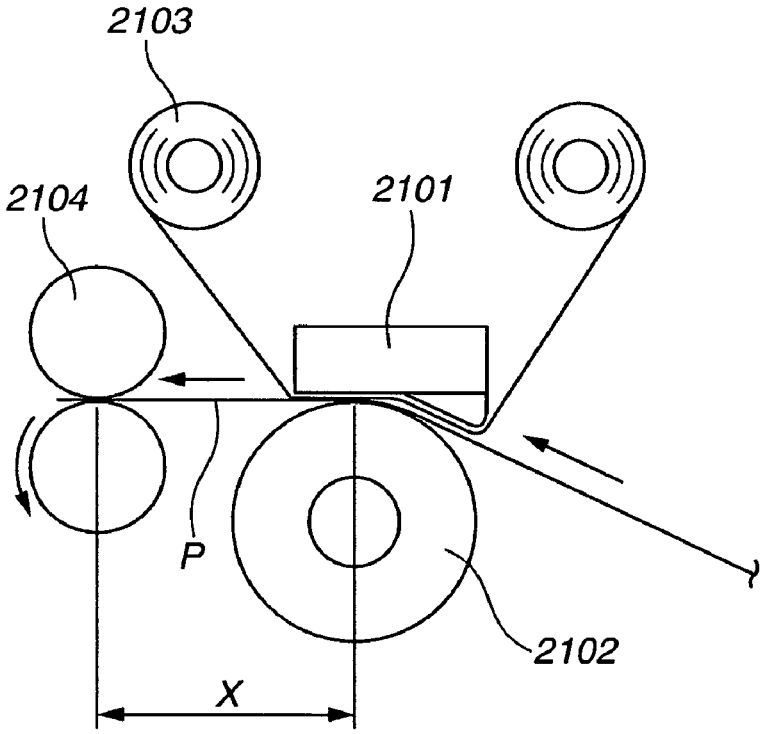
FIG.24 PRIOR ART
FIG. 24 is a diagrammatic vertical sectional view of the schematic arrangement of a conventional thermo-transfer type printing apparatus.

The recording paper P is nipped and conveyed by a pair of the sheet feeding rollers 4, serving as a transport unit, which are disposed downstream of the thermal head 1 in the transport direction. The recording paper P is made to contact the platen roller 2 by pressure from the thermal head 1. Heat elements of the thermal head 1, which are driven based on the image information, transfer ink of the ink sheet 3 to the recording paper P to form an image on the recording paper P. On this occasion, the recording paper P serving as a recording medium is pulled and then conveyed in the arrow direction by the sheet feeding rollers 4 while pressure is applied between the thermal head 1 and the platen roller 2. Accordingly, the recording paper P is permanently subjected to tension between the thermal head 1 and the sheet feeding rollers 4 (transport rollers), and printing (image-forming) is performed while the recording paper P is being conveyed accurately. The above-mentioned printing operation is substantially identical with the conventional apparatus which is described with reference to FIG. 24.

As shown in FIGS. 11 and 12, the present embodiment has a rotating unit upstream of the recording head 1 (thermal head) in the transport direction, which rotates the recording paper P in the sheet transport path so as to reverse it with respect to the forward-and-rearward direction. The rotating unit 5 has, at two locations, moving units for nipping the recording paper P on both of its surfaces. In other words, the rotating unit 5 includes moving units 5*a*, 5*b* disposed so as to nip the recording paper P at a predetermined interval in the transport direction. The moving unit 5*a* includes a drive roller 6*a* for advancing (moving) the recording paper P in a predetermined direction, and an abutting member 7*a* for preventing the recording paper P from advancing. On the other hand, another moving unit 5*b* also includes a drive roller 6*b* for advancing (moving) the recording paper P in a predetermined direction, and an abutting member 7*b* for preventing the recording paper P from advancing. The drive roller 6*a* and the drive roller 6*b* are adapted to rotate in directions opposite to each other, so as to rotate the recording paper P.

In the present embodiment, the drive rollers 6*a* and 6*b* rotate in the directions shown by arrows A, B in FIG. 12, respectively. Therefore, the moving unit 5*a* advances the recording paper P at its pressure-contacting portion in the direction of the arrow A, and simultaneously, the moving unit 5*b* advances the recording paper P at its pressure-contacting portion in the direction of the arrow B. As a result, a force couple is applied in the directions of arrows A, and B to the recording paper P, and the recording paper P is rotated in the direction of the arrow C in FIG. 12. Then, by controlling the rotations of the respective drive rollers 6*a*, 6*b*, the recording paper P is reversed in the forward-and-rearward direction in the sheet transport path. In the present embodiment, two sets of the moving units 5*a*, 5*b* of the rotating unit 5 reverse the recording paper P in the forward-and-rearward direction when the recording paper P is curved in the transport direction.

In the present embodiment, the rotating unit 5 is employed which includes two sets of the moving units 5*a*, 5*b* rotating in directions opposite to each other; however, in place of this configuration, for example, the recording paper P can be nipped at its center portion on both of its surfaces and then its center portion can be rotated (for example, as described in Japanese Patent Application Laid-Open No. 2002-234636), or a force couple can be applied to the recording paper P by an abutting member which creates an abutment in relation to a transport roller and the recording paper P (for example, as described in Japanese Patent Application Laid-Open No. 9-40230).

Figure 13A:
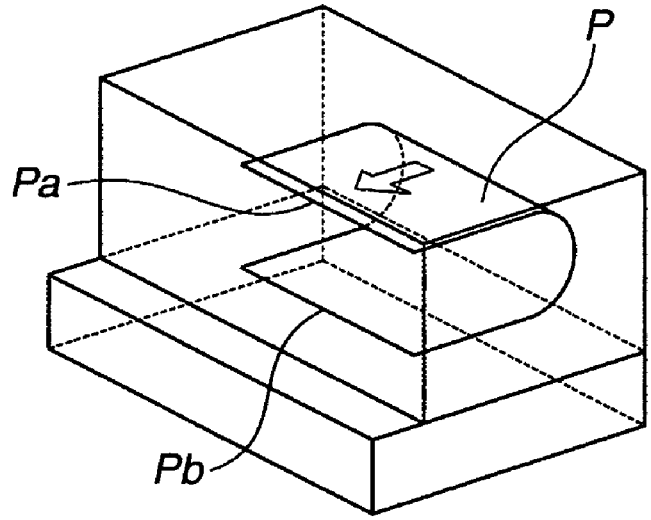
FIGS. 13A to 13C are diagrammatic perspective views showing how the recording paper being conveyed is rotated by the rotating unit and then reversed with respect to the forward-and-rearward direction in the sheet transport path.
Figure 13B:
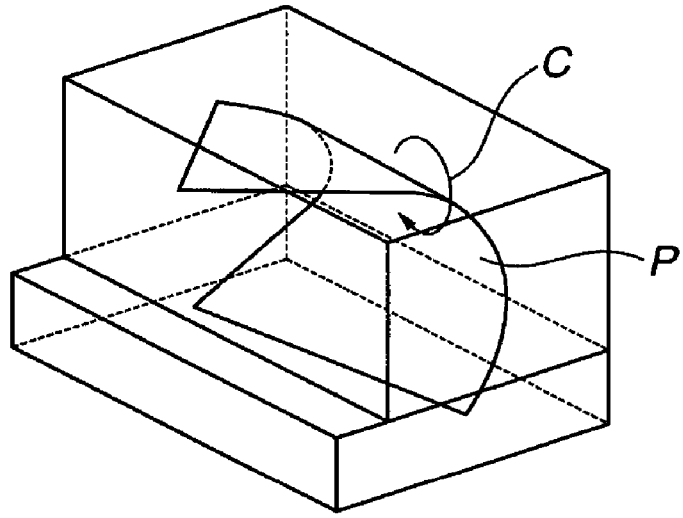
Figure 13C:
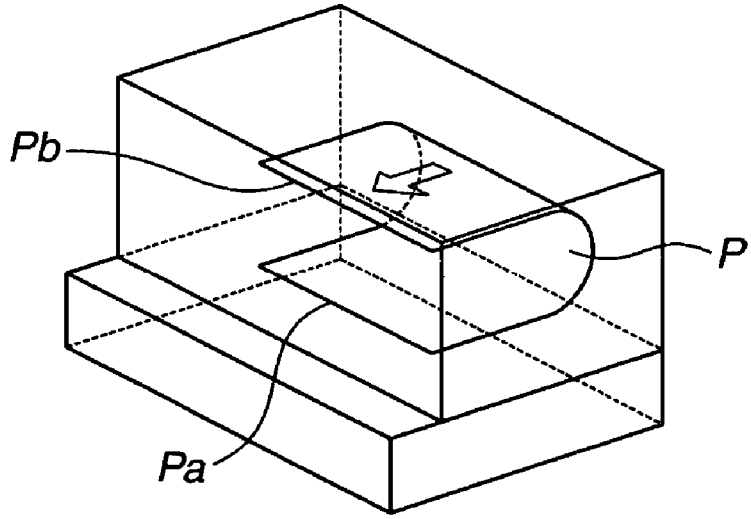

FIGS. 13A to 13C are diagrammatic perspective views showing that the recording paper P being conveyed is rotated by the rotating unit and then reversed in the forward-and-rearward direction within the sheet transport path, in which FIG. 13A shows the transport state before rotation, FIG. 13B shows a state in the midst of rotating, and FIG. 13C shows the transport state after rotation.

Moreover, in FIGS. 13A to 13C, Pa designates the leading edge of the recording paper P in the transport direction before rotation, and Pb designates the trailing edge of the recording paper P before rotation. FIG. 13A shows that the recording P is conveyed with its leading edge Pa directed forward (at the head), FIG. 13B shows that the recording paper P is rotated by the rotating unit 5, and FIG. 13C shows that the recording paper P is reversed in the forward-and-rearward direction (the trailing edge Pb is at the head and the leading edge Pa is at the rear end).

Figure 14:
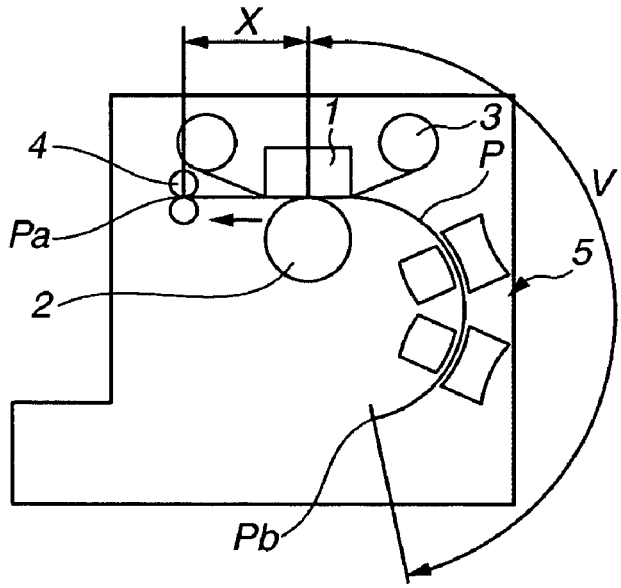
FIG. 14 is a diagrammatic vertical sectional view which shows the state in which the printing apparatus according to the first embodiment of the invention starts performing a first printing process.
Figure 15:
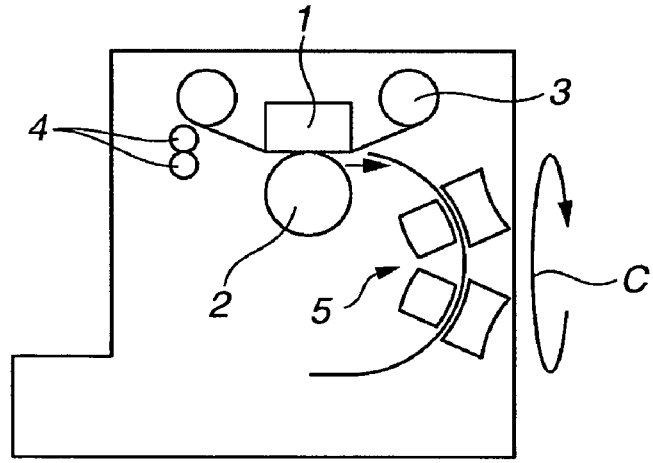
FIG. 15 is a diagrammatic vertical sectional view which shows a rotating process in reversing the recording paper in the forward-and-rearward direction in the printing apparatus.
Figure 16:
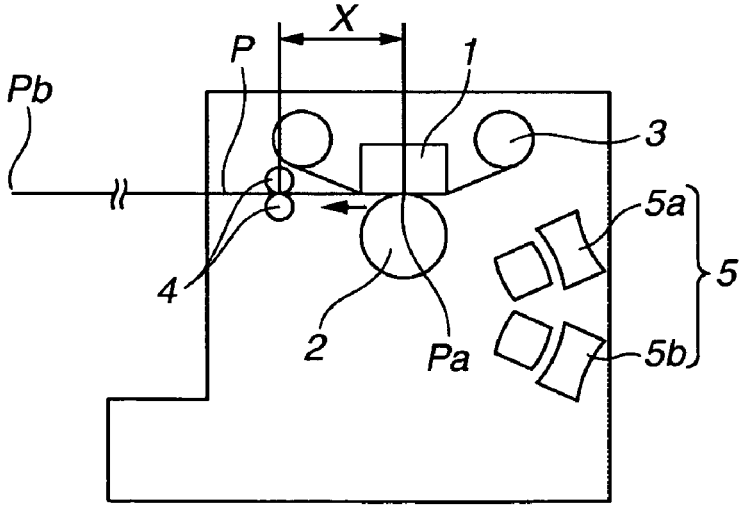
FIG. 16 is a diagrammatic vertical sectional view which shows the state in which the printing apparatus of FIG. 14 terminates a second printing process.

FIGS. 14 to 16 are diagrammatic vertical sectional views which show the schematic arrangement and an operation of the first embodiment of a printing apparatus according to the invention. FIG. 14 shows the state in which the first printing process (first image forming process) is started, FIG. 15 shows the rotating process of reversing the recording paper with respect to the forward-and-rearward direction, and FIG. 16 shows the state in which the second printing process (second image forming process) is terminated.

In the first printing process of FIG. 14, printing is performed on the recording paper P which is pulled and conveyed by the sheet feeding rollers 4 with the leading edge Pa at the front as shown in FIG. 13A. However, in the first printing process, the printing cannot be performed before the leading edge Pa of the recording paper P reaches the sheet feeding rollers 4. Therefore, in this first printing process, printing is possible only in a range V (a first region) shown in FIG. 14 at a maximum, and hence printing is performed on a desired region within the range V. This printing operation is substantially identical with the conventional process which is described with reference to FIG. 24.

A rotating process for reversing the recording paper P with respect to the forward-and-rearward direction shown in FIG. 15 is performed after the above-mentioned first printing process. In this rotating process, after having performed the printing at the first printing process, the recording paper P is first returned to a location shown in FIG. 15, and then rotated by about 180° so as to be reversed with respect to the forward-and-rearward direction in the rotating operation by the rotating unit 5 shown in FIG. 15.

In the second printing process of FIG. 16, printing is performed on the recording paper P which is pulled and conveyed by the sheet feeding rollers 4 with the trailing edge Pb in the front as shown in FIG. 13C. On this case, the recording paper P is reversed with respect to the forward-and-rearward direction compared with the first printing process of FIG. 14. Consequently, in the second printing process of FIG. 16, the printing is performed in a range X (a second region) of the trailing edge of the recording paper P, on which printing cannot be performed in the above-mentioned first printing process. The printing operation itself in the second printing process is substantially identical with the conventional process described in FIG. 24, while the recording paper p is reversed with respect to the forward-and-rearward direction.

Figure 17:
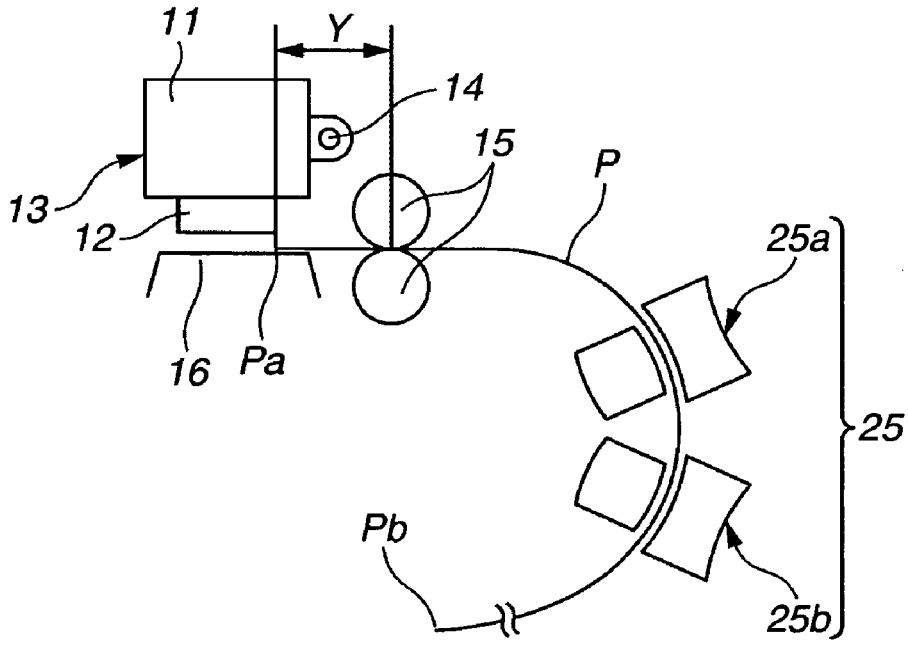
FIG. 17 is a diagrammatic vertical sectional view which shows the state in which the printing apparatus according to the second embodiment of the invention starts performing a first printing process.
Figure 18:
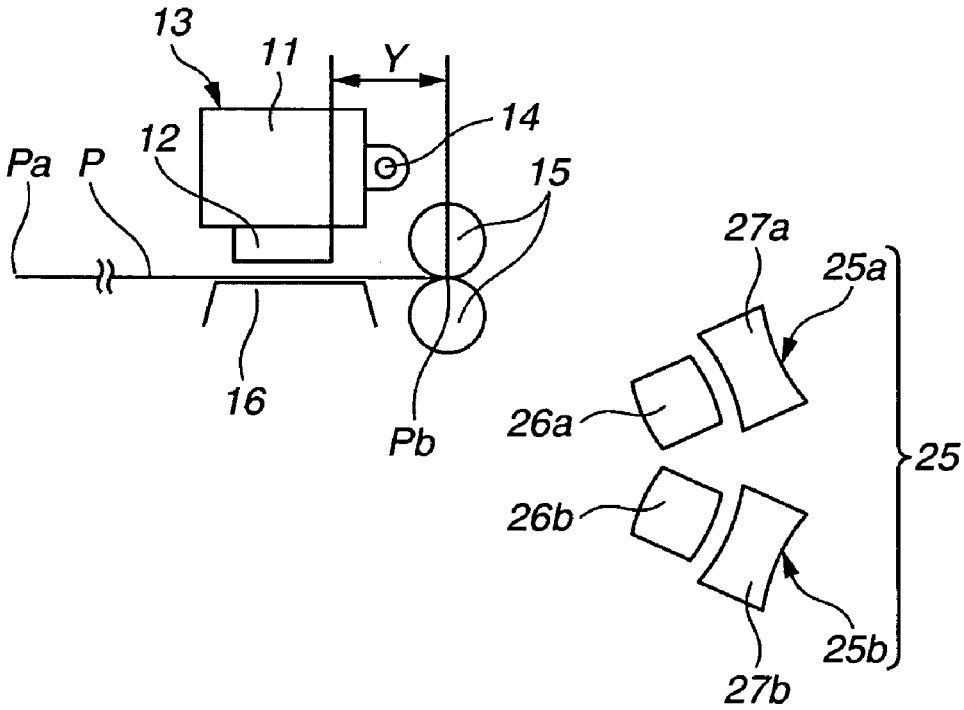
FIG. 18 is a diagrammatic vertical sectional view which shows the state in which the printing apparatus in FIG. 17 terminates the first printing process.
Figure 19:
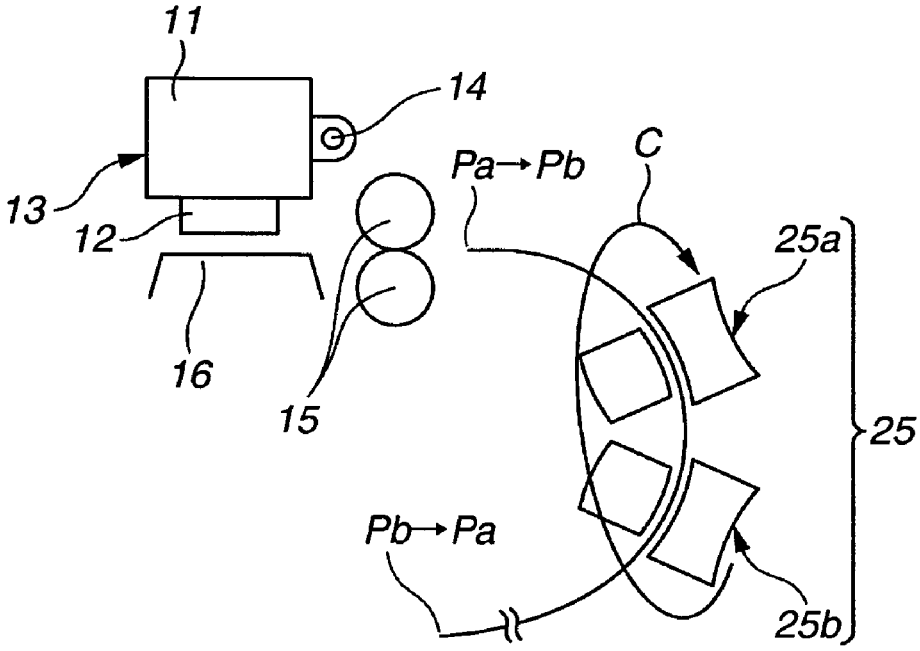
FIG. 19 is a diagrammatic vertical sectional view which shows a rotating process in reversing the recording paper in the forward-and-rearward direction in the printing apparatus of FIG. 17.
Figure 20:
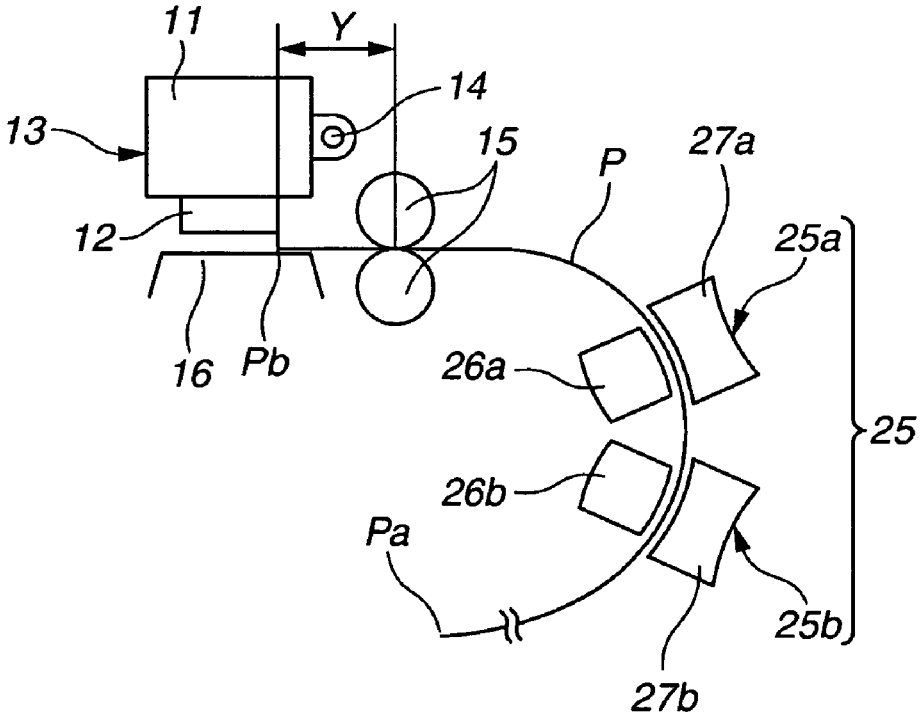
FIG. 20 is a diagrammatic vertical sectional view which shows the state in which the printing apparatus of FIG. 8 starts performing a second printing process.
Figure 21:
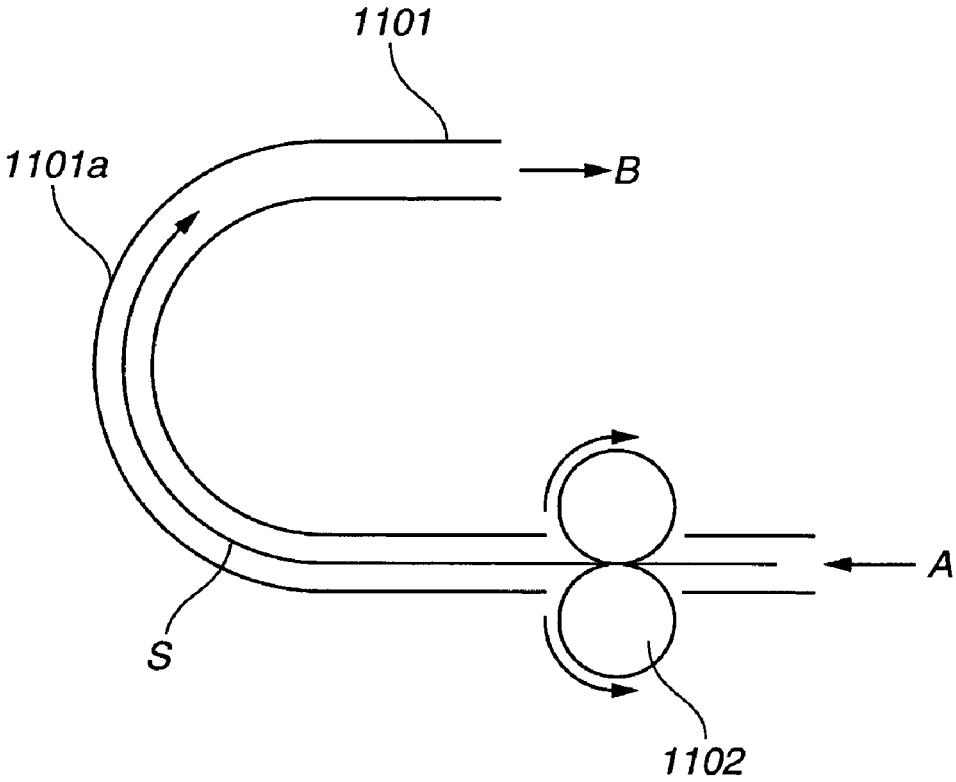
FIG.21 PRIOR ART
FIG. 21 is an explanatory view of a conventional sheet transporting apparatus.
Figure 22:
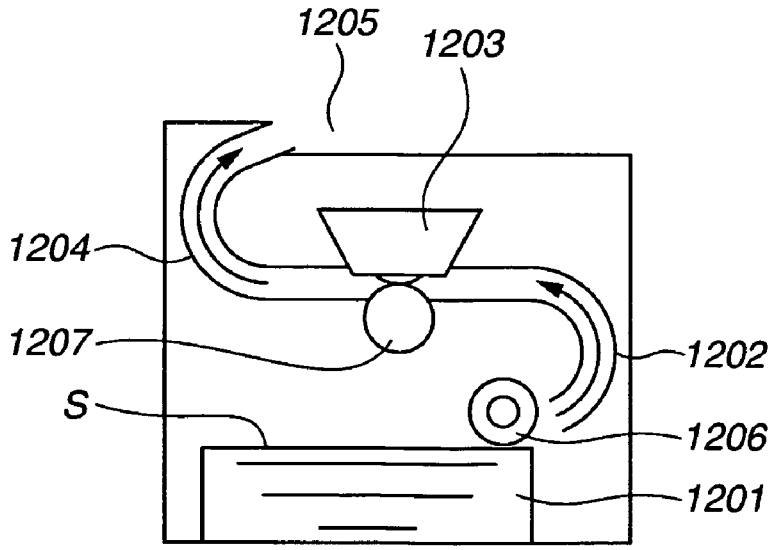
FIG.22 PRIOR ART
FIG. 22 is an explanatory view of a conventional image recording apparatus.
Figure 23A:
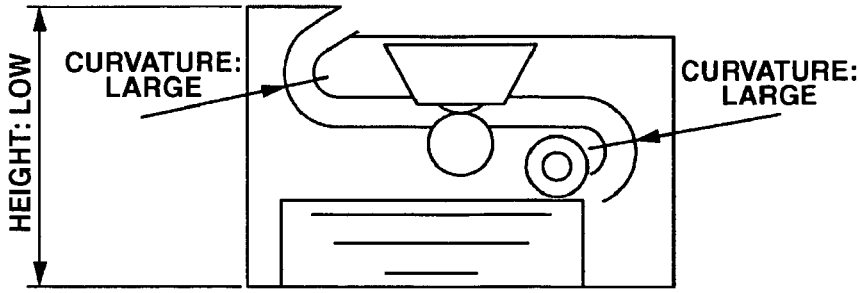
FIG.23A PRIOR ART
FIGS. 23A to 23C are views illustrating the maximum curvature in the conventional image recording apparatus.
Figure 23B:
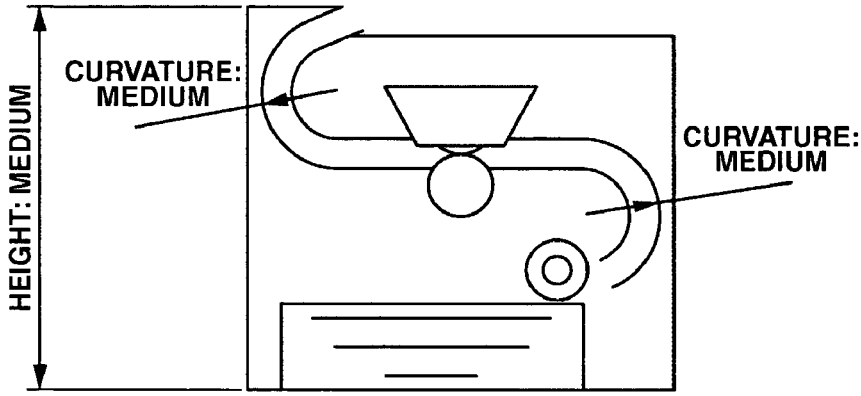
FIG.23B PRIOR ART
Figure 23C:
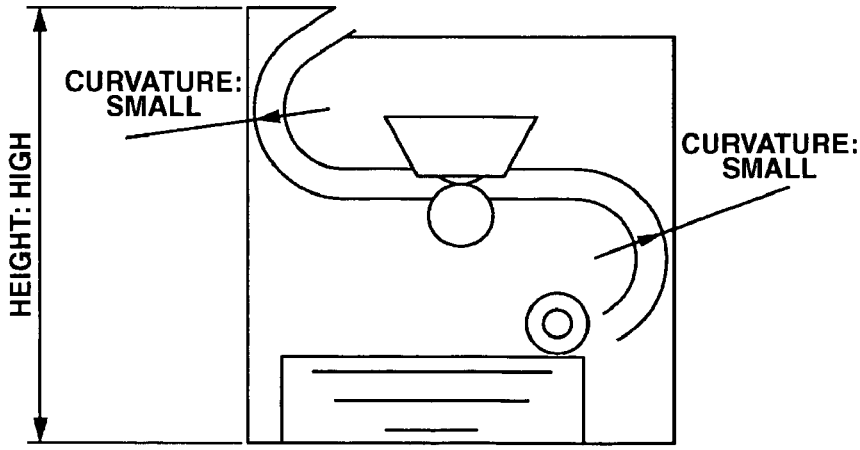
FIG.23C PRIOR ART

FIGS. 17 to 20 are diagrammatic vertical sectional views which show the schematic arrangement and operation of a printing apparatus according to the second embodiment of the invention. FIG. 17 shows the state in which the first printing process is started, FIG. 18 shows the state in which the first printing process is terminated, FIG. 19 shows the rotating process for reversing the recording paper with respect to the forward-and-rearward direction, and FIG. 20 shows the state in which the second printing process is started.

In the present embodiment, an ink jet type printing apparatus using an ink jet recording head is described as an example of a recording head.

In FIGS. 17 to 20, reference numeral 11 designates an ink tank for storing ink used for image-forming; reference numeral 12, an ink jet head as an image forming unit including a plurality of discharge ports for selectively jetting ink supplied from the ink tank 11 based on image information; reference numeral 13, a carriage carrying the ink tank 11 and the ink jet head 12, and reciprocally moving in the main-scanning direction; reference numeral 14, an guide shaft for guiding and supporting the reciprocally moving carriage 13; reference numeral 15, sheet feeding rollers disposed upstream of the ink jet head 12 in the transport direction, for transporting the recording paper P; and reference numeral 16, a platen for supporting the recording paper P which is fed through the ink jet head 12.

The carriage 13 is reciprocally driven in the recording paper width direction (in a direction perpendicular to the drawing off of the paper) by a moving unit (not shown). The ink jet head 12 is driven based on the image information in synchronization with the movement of the carriage 13 so that the ink is jetted in accordance with the image from said plurality of discharge ports of the ink jet heads 12, and the image is printed on the recording paper P. When the printing of one line is finished, the sheet feeding rollers 15 convey the recording paper P by a predetermined pitch, which stops at the next line. Then, the carriage 13 is moved again and the ink jet head 12 is driven to print the next line. Thus, the recording of one line and the sheet-feeding by the predetermined pitch are repeated in turn so as to perform printing on the recording paper P.

According to the present embodiment, the sheet feeding rollers 15 including a pair of rollers are disposed upstream of the ink jet head 12 in the transport direction, and further upstream of the sheet feeding rollers 15 a rotating unit 25 is disposed for rotating the recording paper P in the sheet transport path so as to reverse it with respect to the forward-and-rearward direction. The rotating unit 25 has moving units at two locations for nipping the recording paper P on both of its surfaces, which substantially is the same as the above-mentioned rotating unit 5. In other words, the rotating unit 25 includes moving units 25*a*, and 25*b* disposed in such a manner that the recording paper P is nipped at a predetermined interval in the transport direction.

The moving unit 25*a* includes a drive roller 26*a* for advancing the recording paper P in a predetermined direction, and an abutting member 27*a* for preventing the recording paper P from advancing. Another moving unit 25*b* also includes a drive roller 26*b* for advancing the recording paper P in a predetermined direction, and an abutting member 27*b* for preventing the recording paper P from advancing. The drive roller 26*a* and the drive roller 26*b* are rotatably driven in directions opposite to each other in order to rotate (change the direction of orientation of) the recording paper P. Also in the present embodiment, two sets of the moving units 25*a* and 25*b* of the rotating unit 25 reverse the recording paper P with respect to the forward-and-rearward direction when the recording paper P is being curved in the transport direction.

Also in the present embodiment, the drive units 25*a* and 25*b* are driven, and the moving roller 26*a* advances the recording paper P at its pressure-contacting portion in one direction, and simultaneously, the moving roller 26*b* advances the recording paper P at its pressure-contacting portion in the opposite direction. As a result, a force couple is applied to the recording paper P, thereby causing the recording paper P to rotate in the direction of the arrow C in FIG. 19 (same as the direction of the arrow C in FIG. 12). The rotations of the respective drive rollers 26*a* and 26*b* are controlled such that the recording paper P is reversed with respect to the forward-and-rearward direction in the sheet transport path.

Thus, the rotating unit 25 is substantially identical in configuration with the rotating unit 5 in the above-mentioned first embodiment. The recording paper P, being conveyed with the leading edge Pa in the front(at the head) is reversed with respect to the forward-and-rearward direction so that the trailing edge Pb is directed to the head and the leading edge Pa is at the rear end.

Moreover, in the present embodiment, in place of the above-mentioned rotating unit 25, for example, the recording paper can be nipped at its center portion on both of its surfaces and then that portion can be rotated (for example, the configuration described in Japanese Patent Application Laid-Open No. 2002-234636), or a force couple can be applied to the recording paper by an abutting member which abuts to a transport roller and the recording paper (for example, the configuration described in Japanese Patent Application Laid-Open No. 9-40230).

Next, referring to FIGS. 17 to 20, the printing operation according to the present embodiment is illustrated.

Figure 25:
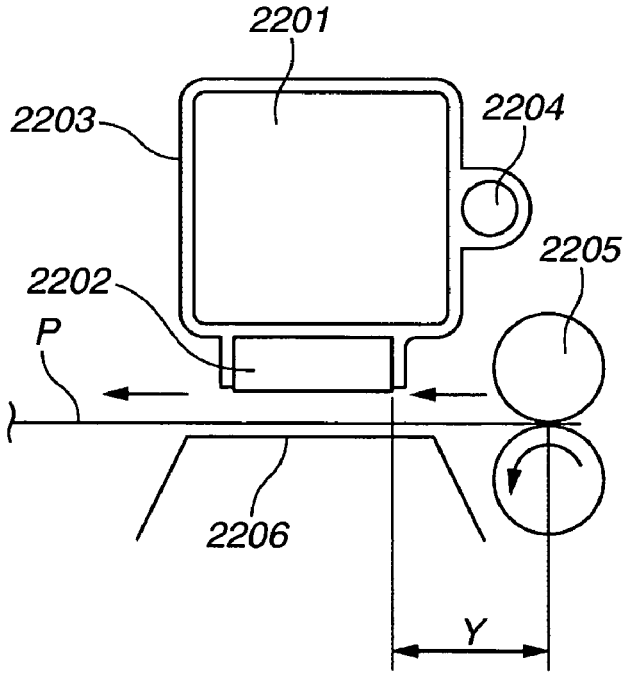
FIG.25 PRIOR ART
FIG. 25 is a diagrammatic vertical sectional view of the schematic arrangement of a conventional ink jet type printing apparatus.
Figure 26:
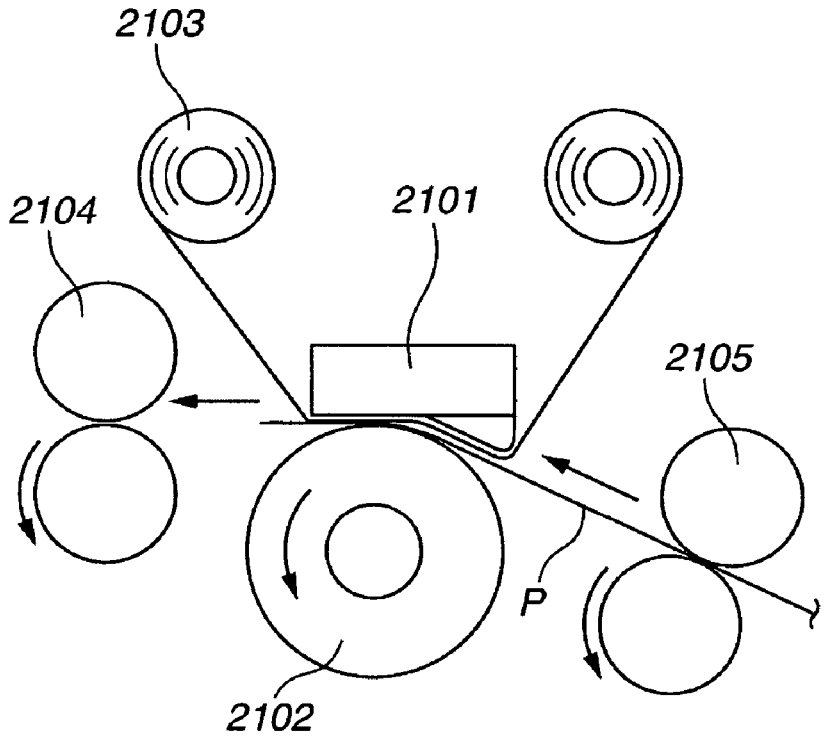
FIG.26 PRIOR ART
FIG. 26 is a diagrammatic vertical sectional view which shows the schematic arrangement of a printing apparatus in which the thermo-transfer type printing apparatus in FIG. 24 additionally has sheet feeding rollers 2105 upstream of the recording head 2101 in the transport direction.
Figure 27:
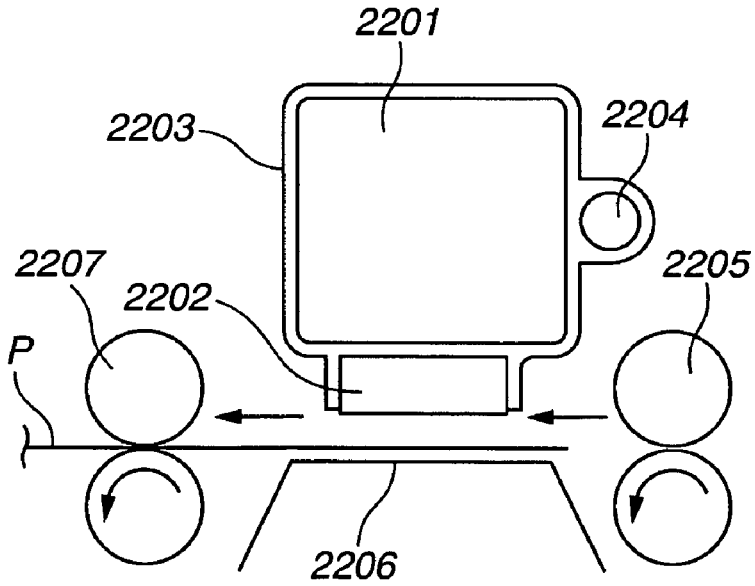
FIG.27 PRIOR ART
FIG. 27 is a diagrammatic vertical sectional view which shows the schematic arrangement of a printing apparatus in which an ink jet type printing apparatus additionally has sheet feeding rollers 2207 upstream of the recording head 2202 in the transport direction.

In the first process carried out from the state of FIG. 17 to FIG. 18, printing is performed on the recording paper P which is conveyed by the sheet feeding rollers 15 with the leading edge Pa in the front. However, in the first printing process, the printing cannot be performed after the trailing edge Pb of the recording paper P passes through the sheet feeding rollers 15. Therefore, printing cannot be performed in a range Y shown in FIG. 18, and hence printing is performed on a desired region of the trailing edge Pb of the recording paper P excluding the range Y. The printing operation is substantially identical with the conventional process which was described in FIG. 25.

A rotating process shown in FIG. 19 is performed after the above-mentioned first printing process. In this rotating process for reversing the recording paper P with respect to the forward-and-rearward direction, after having performed the printing at the first printing process, the recording paper P is first returned (conveyed in the opposite direction) to the location shown in FIG. 19, and then rotated by about 180° in the direction of the arrow C in the sheet transport path so as to be reversed with respect to the forward-and-rearward direction in the rotating operation of the rotating unit 25 shown in FIG. 19.

In the second printing process of FIG. 20, the printing is performed on the recording paper P which is reversed and then conveyed by the sheet feeding rollers 15 with the trailing edge Pb in the front. In this case, the front and rear of the recording paper P is reversed compared with the first printing process of FIGS. 17 and 18. Accordingly, in the second printing process of FIG. 20, printing can be performed also in the range Y of the trailing edge Pb (the leading edge Pb in the second printing process) of the recording paper P, on which printing cannot be performed in the above-mentioned first printing process. The printing operation itself in the second printing process is substantially identical with the conventional process described in FIG. 25, while the front and rear of the recording paper p is reversed.

According to the above-mentioned respective embodiments, there are provided an image forming unit that forms an image on a recording paper; a transport unit (sheet feeding rollers 4 or 15) that conveys the recording paper through the image forming unit; and a rotating unit that reverses the recording paper in the transport path with respect to the forward-and-rearward direction. The printing is performed by sequentially executing first and second printing processes of printing an image. In the first printing process, the printing is performed in a region excluding a range (X or Y) of one end of the recording paper where a transport force is not applied by the transport unit when the recording paper passes through the image forming unit; after reversing the recording paper with respect to the forward-and-rearward direction, the second printing process of printing the image is performed in a region excluding a range of another end of the recording paper where a transport force is not applied by the transport unit when the recording paper passes through the image forming unit.

According to the above configuration, it is possible to provide a printing apparatus and a printing method which are capable of printing on the whole surface of a recording paper without making a margin even when sheet feeding rollers are not disposed both front and back of an image forming unit, but at either the front or the back of the image forming unit.

The above embodiments are described, taking as an example a case in which the invention is applied to a thermal transfer type printing apparatus or an ink jet type printing apparatus. However, any other recording type of printing apparatus, for example, a thermosensitive type, laser beam radiating type, or a wire dot type may be employed. Any apparatus of above types is capable of attaining the same advantageous effect. Further, the invention can be applied to a serial type printing apparatus which carries out recording while main-scanning a recording medium by a recording head, or to a line type printing apparatus which performs printing only by sub-scanning using a recording head which covers the total width or partial width of the recording medium, etc. Therefore, the invention is applicable irrespective of the method of print-scanning, and the similar advantageous effect can be attained.

Besides, the invention can be applied to a printing apparatus using a single recording head, to a color printing apparatus using a plurality of recording heads of different color inks, to a graduation printing apparatus for making print with the same color but different color density using a plurality of recording heads, or to a printing apparatus combining these types. Any of them is capable of attaining a similar advantageous effect. Also, the printing apparatus according to the invention can be applied not only to a printing apparatus singly, but also to a printing apparatus of a composite type such as a copy machine, a facsimile, a captured image forming apparatus, etc. Further it can be widely applied to an apparatus for forming an image based on image information, such as a printing apparatus serving as an output instrument for a composite apparatus, e.g. a computer system, in which a similar advantageous effect can be attained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-349554 filed Dec. 2, 2004, and Japanese Patent Application No. 2004-315104 filed Oct. 29, 2004, which are hereby incorporated by reference herein in their entirety.

What is claimed is:

1. A printing apparatus of printing an image, comprising:

an image forming unit that forms the image on a recording paper;

a transport unit that conveys the recording paper through the image forming unit and in a forward-and-rearward direction, wherein a part of the recording paper is not able to pass through the recording unit while the transport unit conveys the recording paper; and a rotating unit that reverses the recording paper in a transport path with respect to the forward-and-rearward direction, wherein the printing apparatus sequentially performs:

a first printing process of printing a part of the image in a first region of the recording paper while the recording paper is transported by the transport unit, wherein the first region passes through the image forming unit while the transport unit conveys the recording paper in the forward direction;

a reversing process of rotating a recording paper around an axis parallel with a normal line so that a leading edge and a rear end of a recording paper in the forward conveying direction replace each other; and a second printing process of printing the rest of the image in a second region of the recording paper while the recording paper is transported by the transport unit, wherein the second region passes through the image forming unit while the transport unit conveys the recording paper in the forward direction, wherein the first region includes one end of the recording paper and the second region includes another end of the recording paper, and wherein the first region and the second region are on the same surface of the recording paper.

2. The printing apparatus according to claim 1, wherein the rotating unit reverses the recording paper with respect to the forward-and-rearward direction in a state in which the recording paper is curved in the transport direction.

3. The printing apparatus according to claim 1, wherein the rotating unit includes two sets of moving units, each having a drive roller and an abutting member that comes into contact with the recording paper with pressure on both of the surfaces thereof at a predetermined distance in the transport direction.

4. The printing apparatus according to claim 1, wherein the rotating unit has a first moving unit that acts on a portion of the recording paper to advance the recording paper in a predetermined direction, and a second unit that acts on the other portion of the recording paper to advance the recording paper in a direction different from the advancing direction driven by the first moving unit.

5. The printing apparatus according to claim 1, wherein the image forming unit is provided with a thermal head having a heating unit of a plurality of heating resistors arranged in line.

6. The printing apparatus according to claim 1, wherein each of the moving units includes a drive roller that acts on a portion of the recording paper to advance the recording paper in a predetermined direction, and an abutting member that prevents the recording paper from advancing.

7. A printing method of printing on recording paper using:

an image forming unit that forms an image on the recording paper;

a transport unit that conveys the recording paper through the image forming unit and in a forward-and-rearward direction, wherein a part of the recording paper is not able to pass through the recording unit while the transport unit conveys the recording paper; and a rotating unit that reverses the recording paper in a transport path with respect to the forward-and-rearward direction, wherein the printing method sequentially performs:

a first printing process of printing a part of the image in a first region of the recording paper while the recording paper is transported by the transport unit, wherein the first region passes through the image forming unit while the transport unit conveys the recording paper in the forward direction;

a reversing process of rotating a recording paper around an axis parallel with a normal line so that a leading edge and a rear end of a recording paper in the forward conveying direction replace each other; and a second printing process of printing the rest of the image in a second region of the recording paper while the recording paper is transported by the transport unit, wherein the second region passes through the image forming unit while the transport unit conveys the recording paper in the forward direction, wherein the first region includes one end of the recording paper and the second region includes another end of the recording paper, wherein the first region and the second region are on the same surface of the recording paper.

8. A printing apparatus of printing an image on the whole surface of a recording paper, comprising:

a transport unit that conveys the recording paper;

an image forming unit that forms the image on the recording paper which is being conveyed by the transport unit in a region different from a location where the recording paper comes in contact with the transport unit, wherein the image forming unite is not able to form an image on the whole surface of the paper while the transport unit conveys the recording paper; and a rotating unit reverses the recording paper in a transport path with respect to a forward-and-rearward direction, wherein the image forming unit performs a first printing process of printing a part of the image on a first region where the image can be formed by the image forming unit, in a state in which the recording paper is in contact with the transport unit; then the rotating unit that rotates the recording paper around an axis parallel with a normal line so that a leading edge and a rear end of the recording paper in the forward conveying direction replace each other; and then the image forming unit performs a second printing process of printing the rest of the image in a second region where the image can be formed by the image forming unit, in a state in which the recording paper is in contact with the transport unit wherein the first region includes one end of the recording paper and the second region includes another end of the recording paper, wherein the first region and the second region are on the same surface of the recording paper.

9. The printing apparatus according to claim 8, wherein the transport unit conveys the recording paper while nipping the recording paper.

10. The printing apparatus according to claim 8, wherein the image forming unit is disposed upstream of the transport unit in the transport direction.

* * * * *